US012378704B2

(12) United States Patent
Matsuura et al.

(10) Patent No.: US 12,378,704 B2
(45) Date of Patent: Aug. 5, 2025

(54) STRETCH-PROCESSED YARN, FIBER PRODUCT, COMPOSITE SPINNERET, AND COMPOSITE FIBER PRODUCTION METHOD

(71) Applicant: Toray Industries, Inc., Tokyo (JP)

(72) Inventors: Tomohiko Matsuura, Mishima (JP); Hideki Morioka, Otsu (JP); Masato Masuda, Mishima (JP)

(73) Assignee: Toray Industries, Inc., Tokyo (JP)

( * ) Notice: Subject to any disclaimer, the term of this patent is extended or adjusted under 35 U.S.C. 154(b) by 598 days.

(21) Appl. No.: 17/291,346

(22) PCT Filed: Nov. 1, 2019

(86) PCT No.: PCT/JP2019/043169
§ 371 (c)(1),
(2) Date: May 5, 2021

(87) PCT Pub. No.: WO2020/095861
PCT Pub. Date: May 14, 2020

(65) Prior Publication Data

US 2022/0002913 A1 Jan. 6, 2022

(30) Foreign Application Priority Data

Nov. 6, 2018 (JP) ..... 2018-209024
Nov. 6, 2018 (JP) ..... 2018-209025

(51) Int. Cl.
*D02G 3/32* (2006.01)
*D02G 1/18* (2006.01)
*D02G 3/22* (2006.01)

(52) U.S. Cl.
CPC ..... *D02G 3/326* (2013.01); *D02G 1/18* (2013.01); *D02G 3/22* (2013.01)

(58) Field of Classification Search
CPC ..... D02G 3/326; D02G 1/18; D02G 3/22
(Continued)

(56) References Cited

U.S. PATENT DOCUMENTS 2,936,482 A 5/1960 Kilian
2,987,797 A 6/1961 Breen
(Continued)

FOREIGN PATENT DOCUMENTS

CN 1673426 A 9/2005
CN 106367858 A 2/2017
(Continued)

OTHER PUBLICATIONS

Machine Translation JP 48025026 B (Year: 1973).*
(Continued)

*Primary Examiner* — Jenna N Chandhok
(74) *Attorney, Agent, or Firm* — DLA Piper LLP (US)

(57) ABSTRACT

A stretch yarn includes a multifilament including fibers having a coiled crimping form in a fiber axial direction, wherein a coil diameter distribution of crimping in the fiber has two or more groups, a ratio of a maximum group average value to a minimum group average value of the coil diameter (a maximum group average value/a minimum group average value) is less than 3.00, and a cross section of the fibers constituting the multifilament is an eccentric core-sheath cross section.

7 Claims, 13 Drawing Sheets

(58) Field of Classification Search
USPC ..... 428/371
See application file for complete search history.

(56) References Cited

U.S. PATENT DOCUMENTS

| | | | | |
|---|---|---|---|---|
| 3,616,634 | A | 11/1971 | Tomiita et al. | |
| 3,700,545 | A | 10/1972 | Matsui et al. | |
| 4,402,178 | A | 9/1983 | Negishi et al. | |
| 5,196,211 | A | 3/1993 | Goossens | |
| 6,306,499 | B1 | 10/2001 | Ochi et al. | |
| 6,399,194 | B1 * | 6/2002 | Kunisada | D02J 13/001 57/247 |
| 2001/0055683 | A1 | 12/2001 | Ochi et al. | |
| 2003/0052436 | A1 | 3/2003 | Koyanagi et al. | |
| 2009/0068463 | A1 * | 3/2009 | Mochizuki | D01F 8/12 264/168 |
| 2015/0329991 | A1 | 11/2015 | Masuda et al. | |
| 2019/0055674 | A1 | 2/2019 | Tanaka et al. | |
| 2019/0136421 | A1 | 5/2019 | Masuda et al. | |
| 2020/0087820 | A1 | 3/2020 | Suzuki et al. | |

FOREIGN PATENT DOCUMENTS

| | | | | |
|---|---|---|---|---|
| DE | 22 50 496 | A1 | | 4/1974 |
| JP | S44-2504 | | | 2/1969 |
| JP | 48025026 | B | * | 2/1973 |
| JP | 48-025026 | B1 | | 7/1973 |
| JP | S48-25026 | B1 | | 7/1973 |
| JP | S55-27175 | B | | 7/1980 |
| JP | H2-307905 | A | | 12/1990 |
| JP | 11-036141 | A | | 2/1999 |
| JP | 2000-256918 | A | | 9/2000 |
| JP | 2004-183142 | A | | 7/2004 |
| JP | 2005-113369 | A | | 4/2005 |
| JP | 2013-014872 | A | | 1/2013 |
| JP | 5505030 | B2 | | 5/2014 |
| JP | 5703785 | B2 | | 4/2015 |
| JP | 2016-030879 | A | | 3/2016 |
| JP | 2016-188454 | A | | 11/2016 |
| JP | 2017172080 | A | * | 9/2017 |
| KR | 2015-0065520 | A | | 6/2015 |
| TW | 201425666 | A | | 7/2014 |
| TW | 201807275 | A | | 3/2018 |
| WO | 2002/086211 | A1 | | 10/2002 |
| WO | 2017/188104 | A1 | | 11/2017 |
| WO | 2018/110523 | A1 | | 6/2018 |

OTHER PUBLICATIONS

Machine Translation of JP2017172080A (Year: 2017).*
Second Office Action dated Nov. 14, 2022, of counterpart Chinese Patent Application No. 201980073103.1, along with an English translation.
Examination Report dated Aug. 28, 2023, of counterpart Taiwanese Patent Application No. 108140285, along with an English translation.
Partial Supplementary European Search Report dated Dec. 23, 2022, of counterpart European Patent Application No. 19881060.8.
First Office Action dated Apr. 22, 2022, of counterpart Chinese Patent Application No. 201980073103.1, along with an English translation.

* cited by examiner

STRETCH-PROCESSED YARN, FIBER PRODUCT, COMPOSITE SPINNERET, AND COMPOSITE FIBER PRODUCTION METHOD

TECHNICAL FIELD

This disclosure relates to a stretch yarn formed of a multifilament having coiled crimps, and a composite spinneret for manufacturing the stretch yarn.

BACKGROUND

Since fibers using a thermoplastic polymer such as polyester or polyamide have various excellent properties such as mechanical properties and dimensional stability, the fibers are used in a wide range of applications, from clothing applications to interiors, vehicle interiors, and industrial materials. As a more comfortable life is desired, the demand for fiber materials also requires more advanced properties, and materials for clothing that are located at the most familiar range have been actively advanced to obtain the comfort.

The comfort of the materials for clothing has various properties depending on the environment and atmosphere in which the materials are used. However, it is no exaggeration to say that so-called "stretch performance," which means the property associated with extension and shrinkage of the fabric, is one of the basic properties directly linked to the wearing comfort.

Stretch materials are often used in high-functionality sports clothing for athletes who perform harsh exercise in unique environments. In recent years, the stretch materials are also recognized by general users in terms of ease of wearing and ease of motion, and tend to be adopted in a wide range of apparel materials. Along with such trends, it is not enough to simply achieve stretchability such as simply extension and shrinkage, high-performance stretch materials in which other functions are added and the behavior of extension and shrinkage is controlled to express stretchability more complicatedly and highly has been actively developed.

It is common that when a person wears clothing and motions, the person feels stress due to the rubbing between the clothing and the skin and the tension when the person makes a large motion, and being free from the stress leads to wearing comfort. That is, it leads to a stress-free comfortable clothing material to enhance the motion followability, which means following the motion of a person. To achieve a stress-free stretch material, it is important that the clothing fits the shape of the body and is properly tightened when worn, that is, it extends well while having an appropriate hold sense. To solve these problems, there is a technique related to a latent crimp-expressing fiber in which different polymers are bonded to each other in a side-by-side manner and a spiral structure is expressed by the shrinkage difference.

JP-B-S44-2504 discloses a composite fiber having a side-by-side cross section in which two kinds of polyethylene terephthalate (PET) having different intrinsic viscosities or ultimate viscosities are bonded to each other on the left and right, and JP-A-2005-113369 discloses a technique related to a side-by-side composite fiber made of polytrimethylene terephthalate (PTT) and PET. As described above, it is known that the side-by-side composite fiber in which the two kinds of polymers are bonded to each other develops crimps depending on the difference in shrinkage rate between the polymers when subjected to heat treatment or the like, and such a fiber is typically referred to as a latent crimping fiber. The crimp of the three-dimensional spiral structure can extend and shrink, and the latent crimping fiber becomes a fiber having the stretchability as a good point.

In addition, the latent crimping fiber as described above can express a resistance force during elongation, which is not indispensable to a fabric having an appropriate hold feeling, by utilizing the elongation property due to the polymer structure or controlling the form of crimping, in addition to the elasticity resulting from the elongation of the crimping structure.

JP-A-2000-256918 discloses a technique related to a side-by-side composite fiber made of PTT having different intrinsic viscosities or copolymerization rates. The composite fiber disclosed in JP '918 causes the fiber itself to elongate in a high strain region during elongation deformation by expressing crimp, and becomes a fabric having stretch performance with high resilience and a power feeling depending on the elastic polymer properties of PTT.

In addition to the stretchability due to latent crimping expressed by the shrinkage difference as described above, to further improve the stretchability of the clothing material, it is possible to perform yarn processing, which is disclosed in WO 2002/086211 and JP-A-2017-172080.

WO '211 proposes a PTT false twisted fiber obtained by subjecting side-by-side composite fibers made of PTT to false twisting process. In the technique of WO '211, since crimping by the false twisting is applied in addition to the latent crimping by the false twisting process, the crimp extension and shrinkage force of one fiber can be effectively used, and the fabric having excellent stretchability and instantaneous elongation recoverability is obtained.

JP '080 proposes a composite crimping yarn having a convergence portion and a non-convergence portion in the length direction of the processed yarn by mixing at least two kinds of latent crimping fibers by post-processing. In the processed yarn disclosed in JP '080, the non-convergence portion has stretchability, the convergence portion has a resilience feeling, and the fabric has stretchability with a resilience feeling.

In addition, the latent crimp-expressing fiber expresses more advanced crimping as the shrinkage difference in the yarn manufacturing process of the polymer A on the high shrinkage side and the polymer B on the low shrinkage side is larger, and exhibit excellent stretchability even when the fiber is made into a fabric. To achieve this, for example, it is considered to increase the difference in the melt viscosity between the polymer A and the polymer B to be combined, but it is known that as the difference in melt viscosity between polymers is increased, the discharge stability is lowered, and stable manufacture may become difficult.

FIG. 8B is a typical composite spinneret used for spinning a latent crimp-expressing fiber having a composite cross section as shown in FIG. 8A. When two kinds of thermoplastic polymers having different melt viscosities are spun using such a composite spinneret, a polymer on a high viscosity side (high-viscosity polymer A) is pressed by a polymer on a low viscosity side (low-viscosity polymer B), a discharge bending phenomenon in which the composite polymer is discharged in a bent state occurs, and yarn jitter or yarn breakage due to contact with the spinneret surface occurs. Therefore, to perform stable discharge, the discharge conditions may be limited.

It is considered that this discharge bending phenomenon is caused by the flow behavior of the composite polymer flow in the composite spinneret. When two kinds of polymers having different melt viscosities are spun using the composite spinneret as shown in FIG. 8B, as shown in FIG. 8C, the polymer flow of the high-viscosity polymer A guided through an induction hole 1 and the polymer flow of the low-viscosity polymer B guided by an induction hole 2 are joined by an introduction hole 4. Since the melt viscosities of the two kinds of polymers are different from each other, it is estimated the resistance received from the wall surface of the introduction hole 4 is different for each polymer flow, such that the velocity distribution in the radial direction in the introduction hole 4 becomes an asymmetrical velocity distribution V2 as shown in FIG. 8C as the velocity distribution advances in the introduction hole 4, and the discharge bending phenomenon occurs in the polymer flow G discharged from a spinneret discharge hole 8.

When the composite polymer having the asymmetric velocity distribution is discharged, a difference in discharge linear velocity is caused between the polymers immediately after the discharge, and a state of being bent toward the high viscosity polymer side is obtained.

To solve such a problem of spinnability, for example, JP-A-H2-307905 proposes a composite spinneret that inhibits the discharge bending phenomenon by controlling the flow velocity when merging polymer flows.

The composite spinneret described in JP '905 will be described with reference to FIGS. 9A and 9B. In the composite spinneret disclosed in JP '905, the polymer flow (high-viscosity polymer flow) of the high-viscosity polymer A guided by the induction hole 1 and the polymer flow (low-viscosity polymer flow) of the low-viscosity polymer B guided by the induction hole 2 are joined by the introduction hole 4. At this time, as shown in FIG. 9B, in the low-viscosity polymer flow, there is a flow path 5 in which the groove width W is continuously widened along the flow direction of the low-viscosity polymer B between the induction hole 2 and the introduction hole 4. Therefore, when the low-viscosity polymer flow is joined to the high-viscosity polymer flow, the flow velocity of the low-viscosity polymer flow is sufficiently low, and as shown in FIG. 9C, the velocity distribution in the cross-sectional direction of the composite polymer flow can be made close to symmetry at the lower portion of the introduction hole 4 (reference numeral "V4" in FIG. 9C), and the discharge bending phenomenon of the polymer flow G discharged from the spinneret discharge hole 8 can be inhibited.

In addition, a proposal related to a composite spinneret that inhibits discharge bending phenomenon by controlling a composite cross section is also disclosed in JP-B-S55-27175.

The composite spinneret disclosed in JP '175 will be described with reference to FIG. 10B. In the composite spinneret disclosed in JP '175, the polymer flow (high-viscosity polymer flow) of the high-viscosity polymer A guided by the induction hole 1 and the polymer flow (low-viscosity polymer flow) of the low-viscosity polymer B guided by the induction hole 2 are joined at the introduction hole 4, the joined polymer flow is allowed to flow down to an introduction hole 7, and the low-viscosity polymer flow entering another induction hole 3 is introduced into the introduction hole 7 via the flow path 6. By allowing the low-viscosity polymer flow guided from the another induction hole 3 to flow down to the spinneret discharge hole 8 while covering the periphery of the joined polymer flow, it is possible to obtain an eccentric core-sheath cross-section as shown in FIG. 10A in which the first component polymer A is surrounded by the second component polymer B. As a result, the resistance received from the wall surface of the introduction hole 7 of each polymer flow becomes constant. Although the velocity distribution in the cross-sectional direction of the composite polymer flow when the first component polymer A is the high-viscosity polymer and the second component polymer B is the low-viscosity polymer has three peaks as shown in FIG. 10C (reference numeral "V5" in FIG. 10C), the radial velocity distribution in the introduction hole 7 can be made close to symmetry. Therefore, the bending of the polymer flow G discharged from the spinneret discharge hole 8 toward the high-viscosity polymer side is reduced, and the discharge bending phenomenon can be inhibited. Typically, when the entire periphery of the side-by-side cross section is coated, it is known that, by shortening the distance between the centers of gravity of the polymers on the composite cross-section, the bending toward the high shrinkage component side during the heat treatment is inhibited, and the crimp-expressing property is lowered. It has been proposed that, in the composite spinneret of JP 175, the low-viscosity polymer flow guided to the induction hole 3 is controlled by adjusting the pressure applied to the induction hole 2 and the induction hole 3 so that the coating portion is made thin and the crimp-expressing property equivalent to that of the side-by-side cross section can be maintained.

In the crimping of substantially the same size that is expressed by the simple side-by-side composite fibers proposed in JP '504 and JP '369, when a load is applied to the fibers or the fabric, entanglement does not occur in the fibers, and eventually, since each fiber bears the stress alone, the fibers extend well with a relatively weak force, an appropriate holding feeling that is the desired effect cannot be obtained, and it is difficult to obtain an excellent motion followability.

Further, in JP '918, the behavior in which the crimping structure is similar to JP '504 and JP '369, and it is difficult to obtain an appropriate holding feeling. Furthermore, with regard to a resistance force which results from the elastic characteristics of the polymer and is applied when the crimped structure is completely extended, depending on the structure of the fabric and the portion used, the resistance may work excessively, and it may be felt as a taut feeling.

In WO '211, by applying the actualized crimping by the false twisting process, crimping of different sizes is mixed in the multifilament so that a wide distribution of the coil pitch and the coil diameter is exhibited among the fibers. In such a state, a fiber having a large coil diameter is slackened and fixed on the multifilament. Since the slack fibers do not contribute to the extension and shrinkage of the multifilament and the resistance force therewith, the resistance force during extension and shrinkage may decrease. Further, since the yarn is a false twisted yarn of the side-by-side composite fiber, in the false twisting process in which the multifilament is twisted while being heated, if the multifilament is processed under an unreasonable condition, peeling between the polymers may occur due to friction or impact during processing or use, and there may be problems such as whitening when a fabric is formed. For this reason, use of the yarn for sports clothing and outdoor clothing for which high wear resistance is required for use in a harsh environment may be limited.

In JP '080, since the convergence portion responsible for the resistance force during yarn extension forms one large spiral structure regardless of the crimping form of the fiber, the spiral structure could not be formed well under the constraint of the fabric structure, and the resilience feeling during elongation was lacking when used as the fabric. Further, focusing on the non-convergence portion, since the difference in the crimping form between the constituent fibers is large, the same kind of fiber is unevenly distributed in the multifilament cross section, and the crimp phases of the plurality of fibers may be aligned by causing the crimping of the same size to bite each other. Therefore, the fibers on the low crimp side float on the surface of the multifilament, and the fabric surface may have an unnecessarily rough feel.

Further, a common feature of the composite spinneret used when spinning the conventional latent crimp-expressing fiber is that there is a flow path between the induction hole and the introduction hole.

The flow path is a groove flow path arranged in a direction perpendicular to the induction hole or the introduction hole, and at least one of the polymer flows is joined to the other polymer in front of the introduction hole via the flow path. At this time, since the polymer flows collide with each other in the vertical direction, there are problems such as a composite cross-sectional change due to a minute change in the flow velocity of the polymer flow and an occurrence of abnormal retention during long-term spinning. In some instances, there is a problem in yarn manufacturing stability such as a sudden decrease in crimpability and yarn breakage due to discharge bending.

In addition, although it is possible to improve the dimensional stability of the composite cross section and inhibit abnormal retention by not providing a flow path between the induction hole and the introduction hole, in this example the flow velocity cannot be controlled through the flow path, and the asymmetry of the velocity distribution at the introduction hole is expanded, the discharge bending phenomenon may be exacerbated.

Further, in the composite spinneret described in JP '175, since the thin skin composite cross section can be formed, the discharge bending can be inhibited even with a sharp change in the viscosity, but since the flow path is provided between the induction hole and the introduction hole, the dimensional stability of the composite cross section is not guaranteed. In addition, to form a coating film, it is necessary to form a pool of a low-viscosity polymer flow guided from another induction hole 3 in the flow path 6 and allow the joined polymer flow of the introduction hole 4 to flow down thereto. However, to make the coating thin, the amount of low-viscosity polymer flow derived from another induction hole 3 must be extremely small, abnormal retention is likely to occur inevitably in the polymer pool in the flow path 6 by using a very small amount of polymer flow, and there was a problem with yarn manufacturing stability.

Further, in the technique of JP '175, since the spinneret flow path joins the polymer flows twice, it is necessary to increase the processing area in the spinneret, and accordingly, the number of fibers (the number of filaments) obtained from one composite spinneret is limited. For this reason, the productivity is significantly reduced, and the development to a wide variety of products may be restricted.

As described above, the composite spinneret that can stably discharge in a wide range of conditions is an extremely important element in manufacturing latent crimp-expressing fibers. However, the composite spinneret has the above-mentioned problems, and there has been a demand for a composite spinneret of latent crimp-expressing fibers that solves these problems.

It could therefore be helpful to provide a stretch yarn capable of providing good stretchability to clothing, a fiber product including the stretch yarn, a composite spinneret for manufacturing the stretch yarn, and a method of manufacturing composite fibers, specifically, to provide a stretch yarn which can be used as a fiber material that has good stretchability, motion followability due to appropriate resistance during extension, and a flexible surface feel according to the crimping form by precisely controlling and improving the crimp forms of the fibers that form the crimp yarn, and a composite spinneret capable of forming a composite cross section capable of significantly inhibiting the discharge bending phenomenon while maintaining the same crimp-expressing property as in the conventional side-by-side cross section (see FIG. 8A) in the composite spinneret for manufacturing the stretch yarn and capable of stably discharging within a wide range of conditions since the dimensional stability of the composite cross section can be maintained at a high level regardless of the discharge range.

SUMMARY

We thus provide (1) to (8):

(1) A stretch yarn including a multifilament including fibers having a coiled crimping form in a fiber axial direction, in which a coil diameter distribution of crimping in the fiber has two or more groups, a ratio of a maximum group average value to a minimum group average value of the coil diameter (a maximum group average value/a minimum group average value) is less than 3.00, and a cross section of the fibers constituting the multifilament is an eccentric core-sheath cross section.

(2) The stretch yarn according to (1), in which the number of fibers included in the group having the minimum group average value of the coil diameter is 20% or more of the total number of fibers constituting the multifilament.

(3) The stretch yarn according to (1) or (2), in which an average diameter of the fibers constituting the multifilament is 15 μm or less.

(4) The stretch yarn according to any one of (1) to (3), in which the extension energy is 1.5 μJ/dtex or more.

(5) A fiber product including the stretch yarn according to any one of (1) to (4) in at least a part of the fiber product.

(6) A composite spinneret for discharging a composite polymer flow constituted by a first component polymer and a second component polymer, in which the composite spinneret includes a measurement plate having a plurality of measurement holes for measuring each polymer component, one or more distribution plates having distribution holes for distributing each polymer component, and a discharge plate, in which in a lowermost layer on a downstream side of the distribution plate in a polymer spinning path direction, a polymer distribution hole group in which a plurality of first component polymer distribution holes of semicircular arrangement are surrounded by a plurality of second component polymer distribution holes is bored, in which at least a part of the second component polymer distribution holes in the polymer distribution hole group is arranged in semicircular arc arrangement on an outer side of a circumferential portion of the plurality of first component polymer distribution holes of semicircular arrangement.

(7) The composite spinneret according to (6), in which the total number of holes Ht of the second component polymer distribution holes in the polymer distribution hole group and the number of holes Ho of the second component polymer distribution holes arranged in semicircular arc arrangement on the outer side of the circumferential portion of the plurality of first component polymer distribution holes of semicircular arrangement satisfy relationship (1):

$$1/16 < Ho/Ht < 1/4 \quad (1).$$

(8) A method of manufacturing a composite fiber using the composite spinneret according to (6) or (7).

Our stretch yarn includes a mixture of a plurality of coiled crimping groups in which the coil diameter is controlled in a multifilament, and exhibits an appropriate elongation resistance from the initial stage of elongation according to the size of the coil diameter, and when the stretch yarn is made into a woven or knitted fabric, the stretch yarn elongates and deforms well while having an appropriate holdability. Therefore, it is possible to provide a stretch material that exhibits stress-free motion followability, and application to a wide range of fiber products can be expected from sports and apparel clothing applications to industrial material applications such as hygienic materials.

In addition, in the composite spinneret used in manufacturing our stretch yarn, it is possible to form a composite cross section capable of significantly inhibiting the discharge bending phenomenon while maintaining the same crimp-expressing property as that of the conventional latent crimp-expressing fiber, and it is possible to maintain the dimensional stability of the composite cross section at a high level regardless of the viscosity and the discharge range of the polymer combined. Therefore, it is possible to manufacture composite fibers having excellent stretchability in a wide range of conditions.

BRIEF DESCRIPTION OF THE DRAWINGS

FIGS. 8A to 8C are views related to a conventional latent crimp-expressing fiber, in which FIG. 8A is a view of a side-by-side cross section which is a composite cross section of a conventional latent crimp-expressing fiber, FIG. 8B is a schematic view of a typical composite spinneret which is used when spinning a latent crimp-expressing fiber having a side-by-side cross section of FIG. 8A, and FIG. 8C is a velocity distribution diagram in a radial direction in an introduction hole where each polymer flow flowing in the composite spinneret of FIG. 8B are joined.

FIGS. 9A to 9C are views related to a composite spinneret of JP '905, in which FIG. 9A is a view of a composite spinneret used in an example of JP '905, FIG. 9B is a cross-sectional view taken along line I-I' of FIG. 9A, and FIG. 9C is a velocity distribution diagram in a radial direction in an introduction hole where polymer flows flowing in the composite spinneret of FIG. 9A are joined.

FIGS. 10A to 10C are views related to the composite spinneret of JP '175, in which FIG. 10A is a view of an eccentric core-sheath cross section which is a composite cross section of the composite fiber of JP 175, FIG. 10B is a schematic view of a composite spinneret which is used for spinning the composite fiber of JP '175, and FIG. 10C is a velocity distribution diagram in a radial direction in an introduction hole where the polymer flows flowing in the composite spinneret of FIG. 10B are joined.

FIGS. 11A and 11B are views showing a distribution plate used in an example in which FIG. 11A is a schematic plan view of a polymer distribution hole group bored in a lowermost layer on a downstream side of a distribution plate in a polymer spinning path direction, and FIG. 11B is a composite cross-sectional view of a composite fiber obtained from a composite spinneret using the distribution plate of FIG. 11A.

FIG. 12A is a front cross-sectional view of a main portion constituting the composite spinneret, FIG. 12B is a front cross-sectional view of a part of the distribution plate, and FIG. 12C is a front cross-sectional view of the discharge plate.

FIGS. 14A and 14B are views related to a conventional distribution plate different from ours in which FIG. 14A is a schematic plan view of a polymer distribution hole group bored in the lowermost layer on a downstream side of the distribution plate in the polymer spinning path direction, and FIG. 14B is a composite cross-sectional view of the composite fiber obtained from the composite spinneret using the distribution plate of FIG. 14A.

REFERENCE SIGNS LIST

Figure 1:
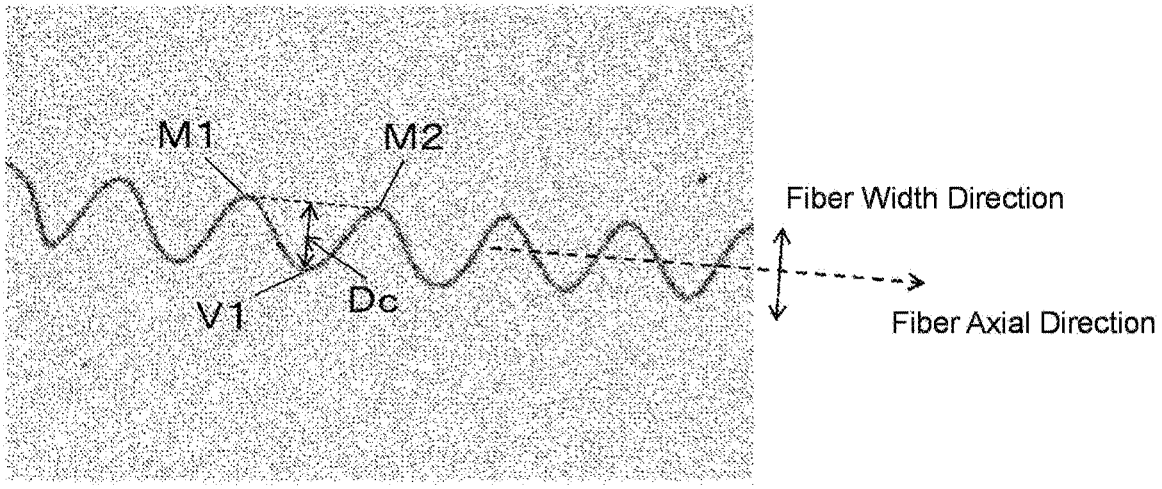
FIG. 1 illustrates an example of fibers constituting our stretch yarn in which a crimping form for illustrating a coil diameter in the crimping form is observed.

M1, M2: Peaks of any adjacent mountains in the crimping form of the fibers constituting the stretch yarn V1: Vertex of a valley in the crimping form of the fiber constituting the stretch yarn Dc: Crimping coil diameter of fibers constituting stretch yarn D: Fiber Diameter

2-(*a*), 2-(*b*): An example of a group in the coil diameter distribution of the fibers of the stretch yarn

3-(*a*): An example of an elongation deformation profile of a multifilament including only one kind of the coil diameter

3-(*b*): An example of the elongation deformation profile of the stretch yarn

4-(*a*): A point where the strength is 0.05 cN/dtex in the elongation deformation profile of the stretch yarn

4-(*b*): An intersection of a perpendicular line drawn from 4-(*a*) toward the horizontal axis and the horizontal axis

5-(*a*), 5-(*c*): Fiber diameter distribution

5-(*b*), 5-(*d*): Central fiber diameter

5-(*e*), 5-(*f*): Distribution width of fiber diameter

6-(*a*): Discharge hole group corresponding to the distribution hole group having a thin skin thickness of 0.04 among the discharge holes in the discharge plate of the spinneret used in Example 10

6-(*b*): Discharge hole group corresponding to the distribution hole group having a thin skin thickness of 0.09 among the discharge holes in the discharge plate of the spinneret used in Example 10

A: Core component (first component polymer, high viscosity polymer)
B: Sheath component (second component polymer, low viscosity polymer)
G: Discharged polymer flow
V1 to V5: Velocity distribution of the polymer inside the introduction hole
W: Groove width
a: Center of gravity point of polymer A in the composite cross section of the fiber transverse cross section
c: Center point of composite cross section of the fiber transverse cross section
S: The minimum thickness of the polymer B in the composite cross section of the fiber transverse cross section
1, 2, 3: Induction Hole
4, 7: Introduction Hole
5, 6: Flow path
8: Spinneret discharge hole
9: First component polymer distribution hole
10: Second component polymer distribution hole
11: The outermost circumscribed circle of the polymer distribution hole group
12: Straight line
13: Curve
14: Measurement plate
15: Distribution plate
16: Discharge plate
17: Distribution groove
18: Distribution hole
19: Discharge introduction hole
20: Reduction hole
21: Spinneret discharge hole
22*a*: Measurement hole for the first component polymer
22*b*: Measurement hole for the second component polymer

DETAILED DESCRIPTION

Hereinafter, our stretch yarns, fiber products and methods will be described in detail together with preferred examples.

Our stretch yarn refers to a textured yarn having a property of extending or shrinking when elongation deformation is applied, and the stretch yarn is formed of a multifilament including fibers having a coiled crimping form in the fiber axial direction, and the first requirement is that the crimp coil diameter distribution in the fiber has two or more groups.

The coil diameter of the coiled crimping mentioned here means one of the indexes indicating the crimp size of the fibers constituting the stretch yarn, and when the fibers separated from the multifilament are observed two-dimensionally from the side surface (direction perpendicular to the fiber axis direction), mountains and valleys are alternately observed in the fiber width direction as illustrated in FIG. 1, and the coil diameter can be measured from the observation image. The coil diameter of the crimping will be described in more detail by using an example (FIG. 1) in which the images of the fibers constituting our stretch yarn are captured by the above method.

First, a 10-meter skein of a multifilament sample to be evaluated is prepared by using a sizing reel or the like, immersed in boiling water of 98° C. or more with a load of 0.2 mg/d, and is subjected to an boiling water treatment for 15 minutes. After the multifilament sample having been treated with boiling water is sufficiently dried by air drying, the multifilament sample is applied with a load of 1 mg/d for 30 seconds or more, and then is marked on any part of the multifilament such that the distance between the two points becomes 3 cm. Thereafter, the fiber is separated from the multifilament to not be plastically deformed, and is fixed on the slide glass by adjusting the distance between the markings set in advance to be 3 cm as the original, and an image of the sample is captured at a magnification at which five to ten peaks of crimping can be observed with a digital microscope or the like. In each captured image (FIG. 1), when peaks of any adjacent mountains are M1, M2, and a vertex of a valley between the peaks M1, M2 of the mountain is V1, the shortest distance between a line connecting the peak M1 of the mountain and the peak M2 of the mountain and the vertex V1 of the valley is the coil diameter (Dc) of the crimping. The coil diameter Dc of the crimping is measured up to the first decimal place with a unit of μm.

The same operation is randomly performed on different fibers constituting the multifilament, and this operation is repeated to measure the coil diameter such that the total number of data becomes 100. When the measured values of the coil diameter are divided into classes with a boundary value of 10×n (n: natural number) μm and a width of 10 μm and the vertical axis is a frequency histogram, having two or more groups (mountains) as illustrated in FIG. 2 means that "the coil diameter distribution of crimping has two or more groups." The term "group" refers to when either of the following (1) and (2) is satisfied, and FIG. 2 illustrates a coil diameter measurement result of the stretch yarn having two groups (black colored portions) shown by 2-(*a*) and 2-(*b*).

Figure 2:
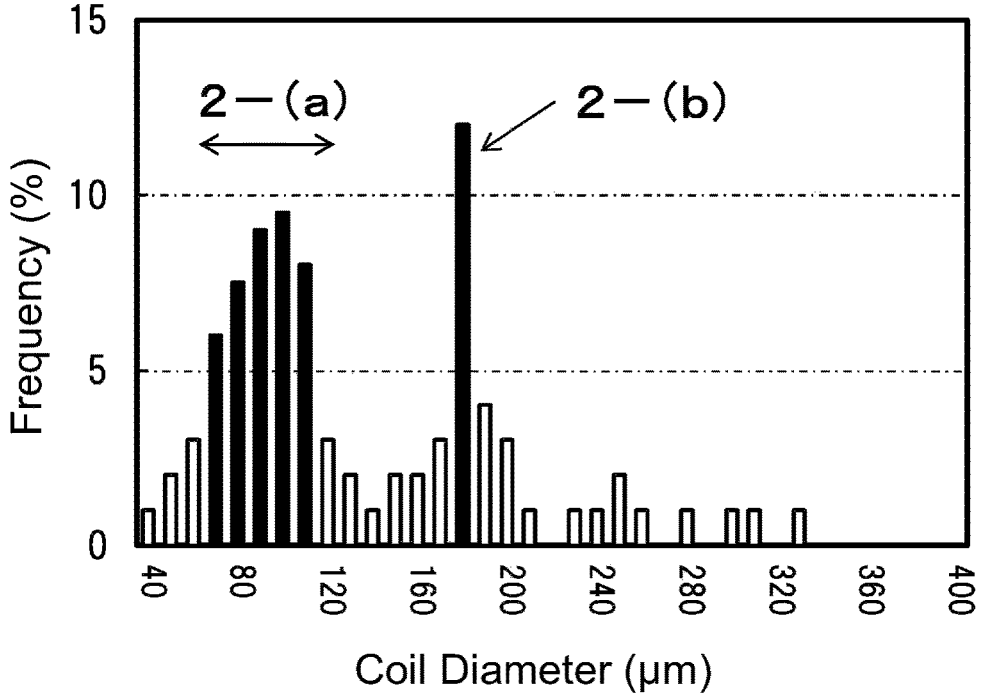
FIG. 2 illustrates an example of a distribution of coil diameters of fibers constituting our stretch yarn.

(1) When there are two or more consecutive classes with a frequency of 5% or more, one group including all the classes is set as one group (illustrated as an example in 2-(*a*) of FIG. 2).

(2) When the frequency of the class exceeds 10% and the frequency of any of the classes before and after the continuous class is less than 5%, the class of 10% or more is set as one group (illustrated as an example in 2-(*b*) of FIG. 2).

The textured yarn having a coil diameter distribution as illustrated in FIG. 2 means that a multifilament is constituted by two or more kinds of fiber groups having a clear difference in crimp size (average coil diameter). In a textured yarn with crimping, when the crimping coil extends and shrinks, the resistance force (stress) during elongation deformation is expressed, and in a multifilament including only one kind of coil diameter, since the fibers constituting the multifilament are uniformly deformed, the profile is monotonous as shown by a dotted line 3-(*a*) in FIG. 3 in which stress (resistance force) does not appear until almost the crimping is fully extended. On the other hand, when two or more kinds of fibers having different coil diameters are present in the multifilament, fibers having different sizes are deformed in an inclined manner according to the elongation of the textured yarn. That is, the profile is a specific deformation profile in which stress is expressed from the range of low elongation as shown by the solid line 3-(*b*) in FIG. 3 such that the fiber having a small coil diameter is deformed in the low elongation region and the fiber having a large coil diameter is deformed in the high elongation region.

This is an important characteristic showing the characteristics of our stretch yarn, and since stress is applied in an inclined manner from the range of the low elongation and an appropriate resistance force is expressed according to the elongation deformation, a good hold feeling is generated when worn as clothes. In an actual textured yarn, a multifilament is formed in a state in which a fiber having a large coil diameter is partially entangled with a fiber having a small coil diameter. Therefore, the multifilament itself is integrally formed without being separated and is easy to handle, and the fiber having a large coil diameter is partially deformed to follow the elongation deformation of the fiber having a small coil diameter so that the entire multifilament has a good elongation deformation.

This effect can be evaluated by the elongation energy as seen in the tensile properties.

Figure 4:
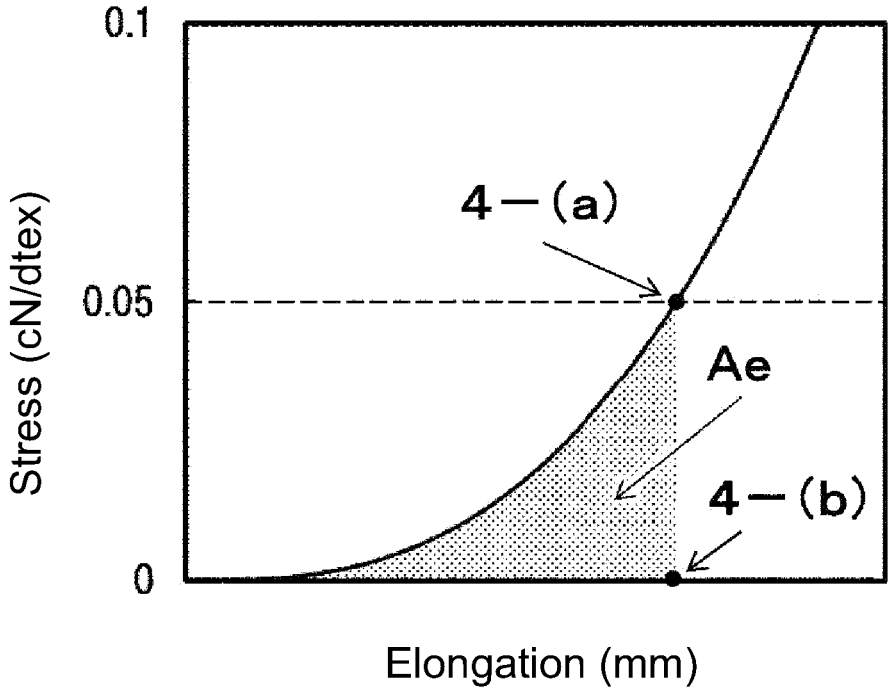
FIG. 4 is a diagram for illustrating extension energy by using an example of an elongation and deformation profile of our stretch yarn.

First, the stretch yarn not subjected to the heat treatment is left to stand under no load for 24 hours at a temperature of 20±2° C. and a relative humidity of 65±2%. After the lapse of 30 seconds or more by applying a load of 1 mg/d to the yarn sample after standing for 24 hours, the yarn sample is fixed to a tensile tester ("TENSILON" UCT-100, manufactured by Orientec Co., Ltd., for example) with the initial sample length set to 50 mm with the load applied. The tensile test of the yarn sample is performed at a tensile velocity of 50 mm/min, and an elongation-stress curve is created as illustrated in FIG. 4 with the horizontal axis as elongation (unit: mm) and the vertical axis as stress (unit: cN/dtex). In the obtained elongation-stress curve, when a point at which the strength is 0.05 cN/dtex is set as 4-(*a*) and an intersection of a perpendicular line drawn from the point 4-(*a*) toward the horizontal axis (stress is 0 cN/tex) and the horizontal axis is set as 4-(*b*), the area Ae surrounded by the points 4-(*a*), 4-(*b*) and the origin represents the elongation energy, and can be calculated with a unit of μJ/dtex. The simple number average of the results obtained by performing the same operation on ten different yarn samples is obtained, and the value rounded off to the first decimal place is the elongation energy.

The elongation energy refers to the amount of energy required for elongation deformation of the material. When the elongation-stress curve of the yarn has a monotonous profile as shown by the dotted line 3-(*a*) in FIG. 3, the elongation energy is a low elongation energy which means that the material is deformed without any resistance during the low elongation deformation that the human exerts in a normal operation, and there is a difference between the deformation of the fabric and the motion of the human. On the other hand, in a multifilament having high elongation energy as shown by the solid line 3-(*b*) in FIG. 3, a resistance force is expressed from the range of the low elongation deformation, and the multifilament is deformed while fitting the motion of the human, and the good hold feeling and the good motion followability can appeal.

For the fabric to have the above-described good motion followability, the elongation energy measured by the method described above is preferably 1.5 μJ/dtex or more. In such a range, it means that an elongation resistance force suitable for following the motion of a human from the range of the low elongation deformation is expressed, and even in wearing with a gentle motion for a long time due to hiking or the like, or when the body is largely moved such as a stretching exercise, the clothes is elongated while comfortably holding the body, thereby providing a comfortable stretch clothing that does not feel stress. In addition, to apply the stretch yarn to sports clothing applications such as athletics or the like in which a relatively quick motion is required or an instantaneously large motion is required, the elongation energy is preferably 2.5 μJ/dtex or more. According to this idea, although it can be said that the higher the elongation energy mentioned here, the greater the hold feeling and the better motion followability, the upper limit value is preferably 10.0 μJ/dtex or less, and the elongation energy is particularly preferably 2.5 μJ/dtex to 10.0 μJ/dtex since the motion of the body may be hindered and the excessive hold feeling may be stressful as tightening by excessively increasing the extension energy.

To make the elongation deformation of the multifilament as described above, it is very important that the correlation of the groups in the coil diameter distribution is in an appropriate range, and thus a specific modified profile can be obtained. That is, in our stretch yarn, the control of the coil diameter difference between the fibers constituting the multifilament is an important requirement and, specifically, it is necessary that the ratio of the maximum group average value of the coil diameter to the minimum group average value of the coil diameter (the maximum group average value/the minimum group average value) is less than 3.00.

The group average value of the coil diameter means a value obtained by classifying the groups from the coil diameter distribution of the multifilament measured by the method described above, calculating the number average of the coil diameters included in each group, and rounding off to the second decimal place. When the group average values calculated by the above-described method are compared in the group of coil diameter distributions, the maximum of the group average values is the maximum group average value and the minimum of the group average values is the minimum group average value. The value obtained by dividing the maximum group average value by the minimum group average value and rounding off to the first decimal place is the ratio of the maximum group average value to the minimum group average value. The larger the value, the larger the deviation of the coil diameter between the fibers constituting the stretch yarn.

In our stretch yarn, to avoid stepwise deformation of the elongation-stress curve of the multifilament to obtain good elongation energy, the ratio of the maximum group average value to the minimum group average value is preferably 1.50 to 2.50.

Furthermore, to make the desired effect more remarkable, the number of fibers included in the group having the minimum group average value of the coil diameter is preferably 20% or more of the total number of fibers constituting the multifilament. In such a range, in the elongation-stress curve of the multifilament, the stress in the low elongation region can be improved, the elongation energy can increase since the stress is well expressed from the low elongation region, and the hold feeling can be suitably expressed when a small motion is performed which is a feature of the stretch yarn. As the number of fibers included in the group having the minimum group average value of the coil diameter is increased, it has the effect of enhancing the hold feeling during low elongation. As a range suitable for application as full-scale sports clothing, the number of yarns included in the group having the minimum group average value can be 40% or more which can be mentioned as a more preferable range. The upper limit of the number of fibers included in the group having the minimum group average value of the coil diameter is not particularly limited, but for fibers having different sizes to be deformed in an inclined manner according to the elongation of the textured yarn, it is preferable that the fibers having a large coil diameter exist at a certain proportion, and from this viewpoint, the number of the yarns included in the group having the minimum group average value is preferably 90% or less of the total number of fibers, and more preferably 80% or less of the total number of fibers.

When it is considered to enhance the adhesiveness between the clothes made of our stretch yarn and the skin of a person, an innerwear or the like, increasing the surface area in contact with the object to be contacted works effectively, and it is preferable to reduce the fiber diameter of the fibers in the multifilament. It is preferable that the average diameter of the fibers is 15 μm or less. In such a range, in addition to an appropriate holding property, the fabric follows the elongation of the skin to greatly reduce rubbing between clothing and the skin, resulting in a comfortable stretch material that exhibits stress-free motion followability.

The average diameter of the fibers can be determined as follows.

First, the stretch yarn is embedded in the form of a multifilament with an embedding agent such as an epoxy resin, and an image of all the fibers is captured at a magnification at which ten or more fibers can be observed with a scanning electron microscope (SEM) or the like in this cross section. In each captured image, the cross-sectional area Af of the fiber is measured using image analysis software (for example, "WinROOF 2015" manufactured by Mitani Corporation), and the diameter of a perfect circle having the same area as the cross-sectional area Af is calculated. This is measured for all the fibers constituting the multifilament, a simple number average is obtained, and the value rounded off to the first decimal place with a unit of μm is the average diameter of the fibers.

Proceeding with the above idea, when the total fineness of the multifilament is the same, since the surface area increases as the average diameter of the fibers decreases, the average diameter of the fibers is more preferably 12 μm or less. Further, as the average diameter of the fibers decreases, the rigidity of the fibers decreases in addition to the adhesiveness when used as a fabric. For this reason, to obtain a fabric that can be applied to an innerwear which directly contacts with a skin or a sports underwear application in which a high followability is required, it is particularly preferable that the average diameter of the fibers is 10 μm or less.

Our stretch yarn has excellent motion followability when used as a fabric, and as a matter of course, can be used for sports and outdoor applications in which the use environment is harsh. Therefore, it is necessary that the fiber cross section has an eccentric core-sheath cross section having excellent wear resistance.

Figure 6A:
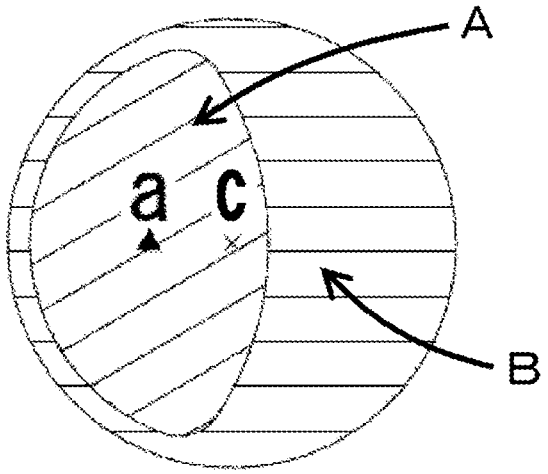
FIGS. 6A and 6B are fiber cross-sectional views for illustrating cross-sectional parameters of a composite fiber having a thin eccentric core-sheath structure.

The eccentric core-sheath cross section means that, for example, in a fiber cross section composed of two or more different kinds of polymers as shown in FIG. 6A, the polymer B as the sheath component completely covers the polymer A as the core component, and the center of the gravity point a of the core component is different from the center point c of the fiber cross section. FIG. 6A illustrates a cross-sectional view of the composite fiber having the eccentric core-sheath cross section, but the horizontal hatching is illustrated as the sheath component (polymer B), 30 deg hatching (diagonal line upward to right) is illustrated as the core component (polymer A), the center of gravity of the core component in the fiber cross section is illustrated as the center of the gravity point a, and the center of the fiber cross-section is illustrated as the center point c.

In such an eccentric core-sheath cross section, since the sheath component completely covers the core component, peeling between the core component and the sheath component (also referred to as "between core and sheath components") can be inhibited so that the fabric quality can be maintained since the whitening phenomenon and fluffing do not occur even if friction or impact is applied to the fibers or the fabric.

Figure 14A:
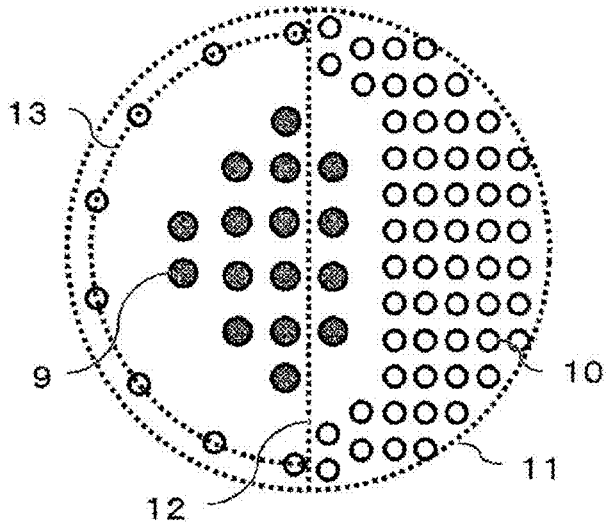
FIG. 14A PRIOR ART
Figure 14B:
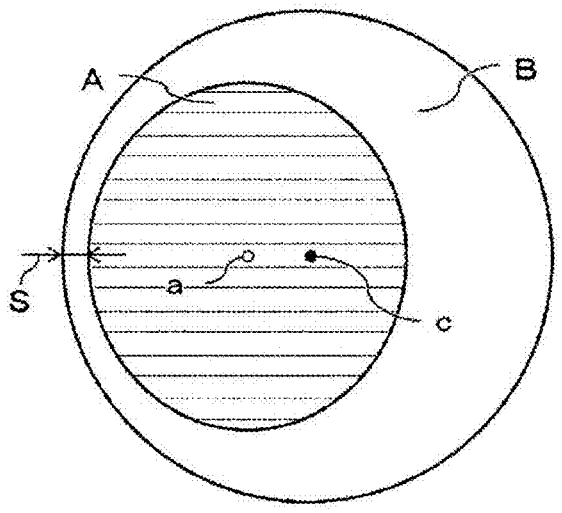
FIG. 14B PRIOR ART

However, in the eccentric core-sheath cross section of the related art as illustrated in FIG. 14B, since the thickness of the sheath component A becomes locally thin, when friction or impact is applied to the fibers, stress is concentrated on the thin portion of the sheath component A and, as a result, peeling may occur between core and sheath components with this portion as a starting point.

In addition, to avoid this, when the thickness of the sheath component is set to be thick, the distance between the center of the gravity point a of the core component and the center point c of the fiber cross section (distance between the centers of gravity) becomes short, and the crimp-expressing of the fibers may be weakened. That is, in the composite fiber having the eccentric core-sheath cross section, the shrinkage difference between the core component and the sheath component occurs due to heat treatment or the like, and the fiber is largely curved so that the three-dimensional coiled crimping is expressed. When the distance between the centers of gravity is short, the moment to bend the fibers is small so that the crimping of the fibers becomes coarse and the stretchability is impaired.

Figure 6B:
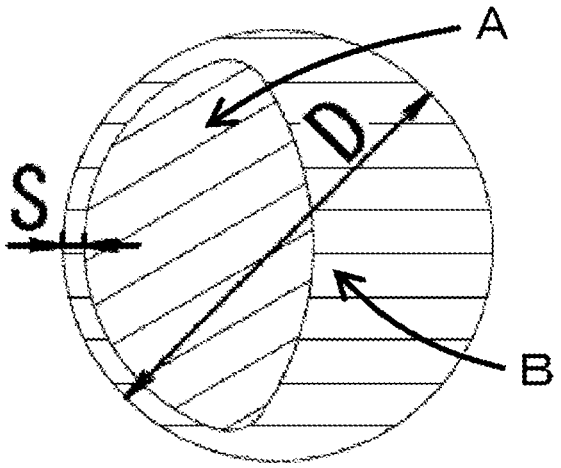

For this reason, in the stretch yarn, as illustrated in FIG. 6B, it is preferable that the cross section of the fiber has a thin skin eccentric core-sheath cross section in which a part of the sheath component is a uniform thin skin.

Since the fiber cross section has the characteristic sheath component arrangement as described above, the stress applied between core and sheath components can be dispersed, and the distance between the centers of gravity which is important for crimping characteristics can be secured.

The term "thin skin eccentric core-sheath cross section" as used herein refers to an eccentric core-sheath cross section that satisfies the following requirements:

(A) The ratio S/D of the minimum thickness S of the component covering the core component to the fiber diameter D of the fiber is 0.01 to 0.10.

(B) The peripheral length portion (S ratio) having a thickness equal to or less than 1.05 times the minimum thickness S accounts for 30% or more of the entire perimeter of the fiber cross section.

The minimum thickness S of the sheath component is obtained as follows, and will be described with reference to FIG. 6B. FIG. 6B illustrates a cross-sectional view of the composite fiber having a thin skin eccentric core-sheath cross section. The horizontal hatching illustrates a sheath component, 30 deg hatching illustrates a core component, the minimum thickness of the sheath component is illustrated as S, and the fiber diameter of the fibers is illustrated as D.

First, the stretch yarn is embedded in the form of a multifilament with an embedding agent such as an epoxy resin, and the image is captured as a magnification at which ten or more fibers can be observed with a transmission electron microscope (TEM) in this cross section. At this time, when metal dyeing is performed, the contrast of the joint portion between the core component and the sheath component can be clarified by utilizing the dyeing difference between the polymers. For ten fibers randomly extracted in the same image from each captured image, a value obtained by measuring the fiber diameter of the fibers by the method described above corresponds to the fiber diameter D of the fiber. When it is impossible to observe 10 or more fibers, a total of ten or more fibers including other fibers may be observed.

In addition, a value obtained by measuring the minimum thickness of the sheath component covering the core component for 10 or more fibers using the image in which the fiber diameter D of the fiber is measured corresponds to the minimum thickness S. Further, the fiber diameter D and the minimum thickness S of these fibers are measured with the unit of μm, and S/D is calculated. With respect to ten images obtained by capturing the above operation, a simple number average value is obtained, and a value rounded off to the second decimal place is obtained.

Since the fiber cross section of our stretch yarn is a thin skin eccentric core-sheath cross section as described above, it is possible to disperse the stress applied between core and sheath components while having good stretchability, and thus good wear resistance can be obtained.

The wear resistance can be evaluated by, for example, the Martindale method shown in JIS L1096 (2010). In the measurement method, the wear test of the standard wear fabric and the fabric sample in which the target fiber is weaved and dyed is performed, the discoloration of the fabric sample is evaluated every 100 times of wear, and the wear resistance is evaluated by the number of times of wear in which the degree of discoloration is equal to that of the reference scale. In the stretch yarn, the wear resistance is preferably 2000 or more. In particular, when used in a harsh environment such as sports or outdoor, the wear resistance is more preferably 2500 or more, and particularly preferably 3000 or more.

When considering the process passability in a high order processing and the actual use when the fibers are processed to form a fabric, it is preferable that the stretch yarn has a toughness of a certain degree or more, and the strength and the elongation at the time of breakage of the fibers are preferably as follows.

The strength is a value determined by obtaining a load-elongation curve of a fiber under the conditions shown in JIS L1013 (2010), dividing the load value at the time of breakage by the initial fineness, and the elongation is a value obtained by dividing the elongation at the time of breakage by the initial sample length. The initial fineness refers to a value obtained by calculating the weight per 10000 m from a simple average value obtained by measuring the weight of the unit length of the fiber a plurality of times.

The strength and the elongation are preferably adjusted by controlling the conditions of a manufacturing process which will be described later depending on the intended use or the like, but as a standard of our stretch yarn, the strength is preferably 0.5 cN/dtex to 10.0 cN/dtex, and the elongation is preferably 5% to 700%.

When our stretch yarn is used for general clothing such as innerwear or outerwear, the strength is preferably 1.0 cN/dtex to 4.0 cN/dtex and the elongation is preferably 20% to 40%. In sports clothing or the like in which the use environment is harsh, the strength is preferably 3.0 cN/dtex to 5.0 cN/dtex, and the elongation is preferably 10% to 40%.

In addition, the fiber diameter unevenness in the fiber longitudinal direction, that is, the Uster unevenness U %, which is an index of fineness unevenness, is preferably 1.5% or less. As a result, it is possible not only to avoid uneven dyeing of the fabric, but also to avoid deterioration of the quality due to the shrinkage unevenness of the fabric, and to obtain a good fabric quality. The Uster unevenness U % is more preferably 1.0% or less.

Our stretch yarn can be made into various fiber products as various intermediates such as a fiber winding package, a tow, a cut fiber, cotton, a fiber ball, a cord, a pile, a woven or knitted fabric, and a nonwoven fabric. The fiber products can be used for not only general clothing such as jackets, skirts, pants, underwear or the like, but also sports clothing, clothing materials, interior products such as carpets, sofas, curtains or the like, vehicular interior products such as car seats, daily purposes such as interior products such as cosmetics, cosmetic masks, wiping cloths, health care products or the like, and environmental and industrial materials such as polishing cloths, filters, hazardous substance removal products, battery separators or the like.

Next, a preferred method of manufacturing our stretch yarn will be described.

In a multifilament including a composite fiber having an eccentric core-sheath cross section, it is necessary that two or more groups are provided in the coil diameter distribution of crimping, and the deviation of the group average value of each group is controlled within a specific range.

As a method of manufacturing the composite fiber having the eccentric core-sheath cross section, a composite spinning using a composite spinneret of a distribution method described in the specification of JP-A-5505030 and JP-A-5703785 is preferably used.

Figure 12A:
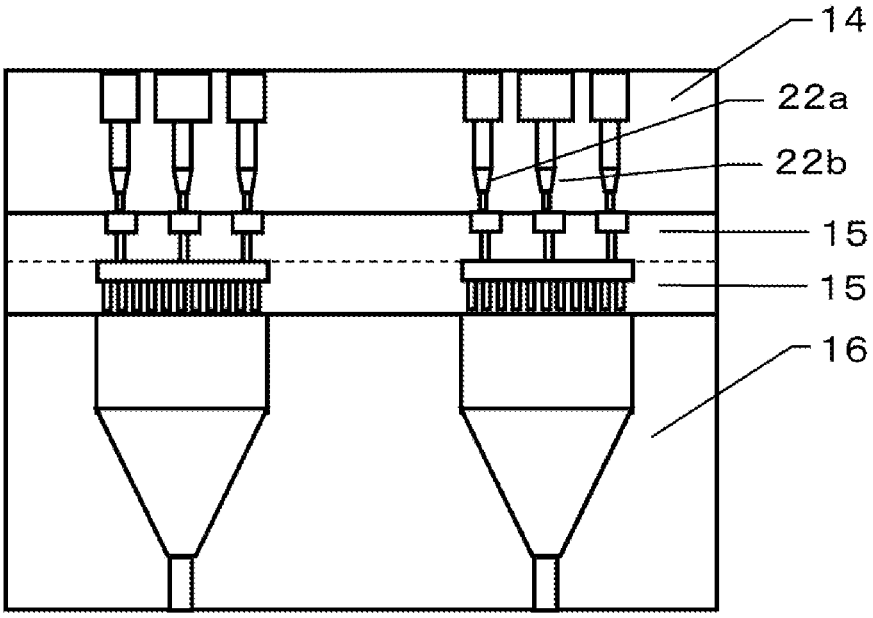
FIGS. 12A to 12C are views explaining our manufacturing method of the composite fiber.
Figure 12B:
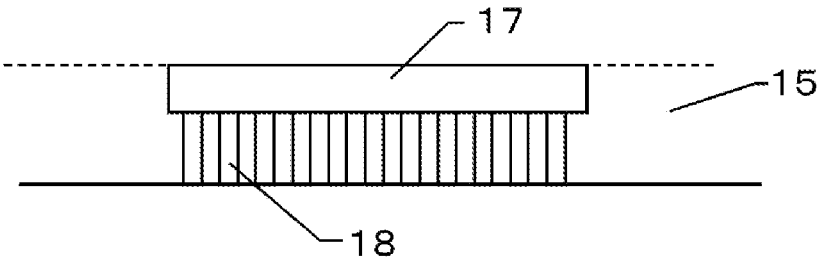
Figure 12C:
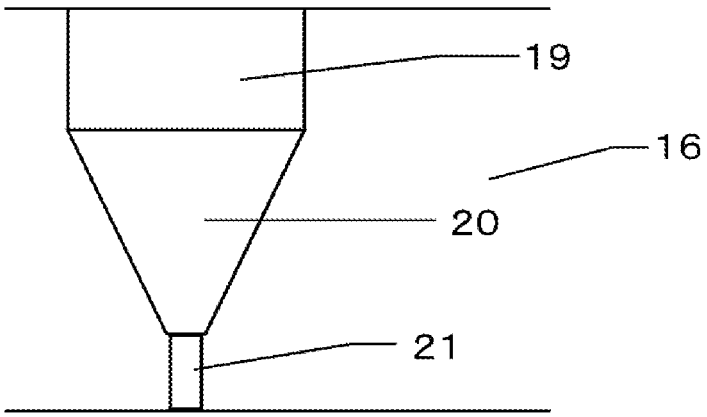

FIGS. 12A to 12C are schematic cross-sectional views of the composite spinneret suitably used.

Note that, since FIGS. 12A to 12C are front cross-sectional views, only two discharge hole groups in which the first component polymer discharge holes or the second component polymer discharge holes are collected are illustrated, but the number of discharge hole groups in an example is not limited.

The composite spinneret is a composite spinneret that discharges a composite polymer flow composed of a first component polymer and a second component polymer, and includes, as shown in FIG. 12A, a measurement plate 14 having a plurality of measurement holes for measuring each polymer component, one or more distribution plates 15 provided with distribution holes 18 for distributing each polymer component, and a discharge plate 16. The composite spinneret shown in FIG. 12A is provided with a distribution plate 15 in which a distribution groove 17 is further formed as a distribution plate 15. Each of the distribution plates 15 is preferably formed of a thin plate. In FIG. 12A, two distribution plates 15 are used. The measurement plate 14 and the distribution plate 15, and the distribution plate 15 and the discharge plate 16 may be positioned such that the center positions (cores) of the spinning packs are aligned with each other by positioning pins, stacked, and fixed with screws or bolts, or may be metal-bonded (diffusion-bonded) by thermocompression bonding. In particular, since the distribution plate 15 uses a thin plate, it is preferable that the distribution plates 15 are metal-bonded (diffusion-bonded) by thermocompression bonding.

The polymer of each component supplied from the measurement plate 14 passes through the distribution groove 17 and the distribution holes 18 of at least one or more stacked distribution plates 15, and then joins to form a composite polymer flow. Thereafter, the composite polymer flow passes through a discharge introduction hole 19 and a reduction hole 20 of the discharge plate 16, and is discharged from the spinneret discharge hole 21.

Although not illustrated to avoid complication of the description of the composite spinneret, a member in which a flow path is formed in accordance with the spinning machine and the spinning pack may be used for a member to be stacked on the upstream side of the measurement plate 14 opposite to the distribution plate 15 side. Incidentally, by designing the measurement plate 14 in accordance with the existing flow path member, the existing spinning pack and the existing member can be used as they are. Therefore, a spinning machine does not need to be specialized for the composite spinneret.

It is also preferable that a plurality of flow path plates (not shown) be stacked between the flow path and the measurement plate 14 or between the measurement plate 14 and the distribution plate 15. This intends a configuration that provides a flow path through which the polymer is effectively transferred in the cross-sectional direction of the spinneret and the cross-sectional direction of the fiber so that the polymer is introduced into the distribution plate 15. The composite polymer flow discharged from the discharge plate 16 is cooled and solidified according to a conventional melt spinning method, and then was applied with an oil agent and was taken up by a roller having a prescribed peripheral velocity to manufacture the composite fiber.

As an important point of achieving the desired effect, the principle of expressing crimping of the composite fiber at a high level while significantly inhibiting the discharge bending phenomenon which is a fundamental problem in conventional manufacturing methods will be described below.

To inhibit the discharge bending phenomenon by the composite cross section, it is most effective to shorten the distance between the centers of gravity of each polymer on the composite cross section and to alleviate the asymmetry of the velocity distribution in the cross-sectional direction of the composite polymer flow. However, when the distance between the centers of gravity of the components is short, even when the shrinkage treatment such as heating is performed, the bending of the fibers toward the high shrinkage component side is reduced, and thus only gentle crimping occurs. That is, in known methods, prevention of discharge bending and advanced crimp-expressing cannot be achieved at the same time, and there is a trade-off relationship between discharge bending and crimp-expressing.

Figure 10A:
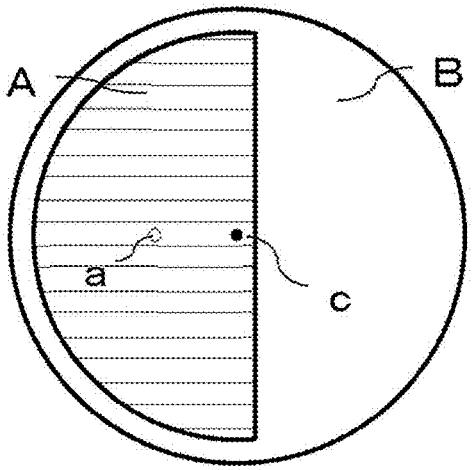
FIG. 10A PRIOR ART
Figure 10B:
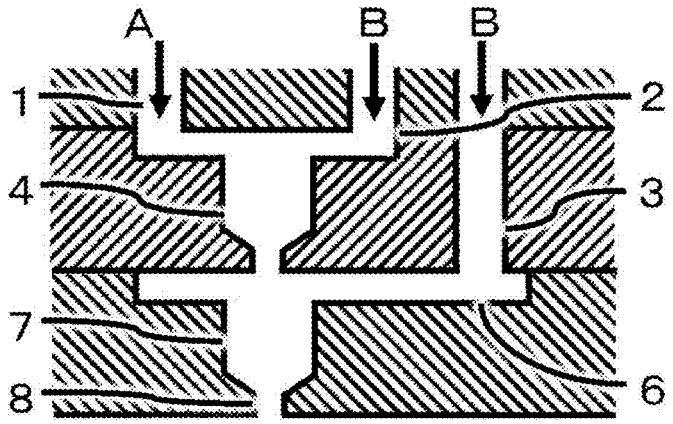
FIG. 10B PRIOR ART
Figure 10C:
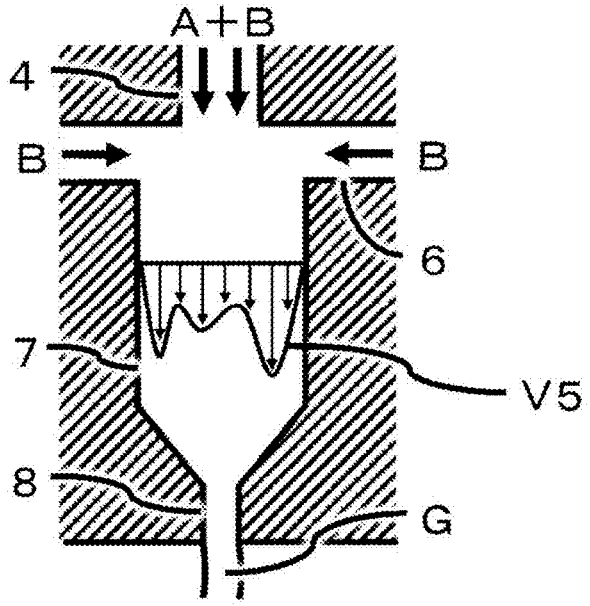
FIG. 10C PRIOR ART

As an effective countermeasure, for example, it is possible to form an eccentric core-sheath cross section in which a thin skin is coated on a side-by-side cross section proposed in JP '175. However, in the composite spinneret of the related art as shown in FIG. 10B and FIG. 10C, it is difficult to form a stable flow with time without causing abnormal retention while precisely controlling the flow of a very small amount of polymer for stably forming an ideal thin film portion, and it is substantially rare to adopt this as a method of manufacturing the latent crimp-expressing fiber. Therefore, in the yarn manufacturing of latent crimp-expressing fiber, the side-by-side cross section is mainly adopted, and the manufacture has been restricted with respect to the discharge conditions such as the single-hole discharge amount, which affects the viscosity of the polymer to be applied and the fineness of the single fiber.

We found that, in the lowermost layer on the downstream side in the polymer spinning path direction of the distribution plate 15, a group of polymer distribution holes in which a plurality of first component polymer distribution holes of a semicircular arrangement are surrounded by a plurality of second component polymer distribution holes is bored, and at least a part of the second component polymer distribution holes in the polymer distribution hole group is arranged in semicircular arc arrangement on the outer side of the circumferential portions of the plurality of first component polymer distribution holes of semicircular arrangement, and thus it is possible to resolve the discharge bending and the crimp-expressing having the above-described trade-off relationship.

The "polymer discharge path direction" refers to the main direction in which each polymer component flows from the measurement plate to the spinneret discharge hole of the discharge plate.

The "polymer distribution hole group" refers to an aggregate of distribution holes which are bored in the lowermost layer on the downstream side in the polymer spinning path direction of the distribution plate 15 and through which the polymer flow of each component passes when the polymer flow of each component is discharged from the distribution plate 15 toward the discharge introduction hole 19 of one hole.

Figure 11A:
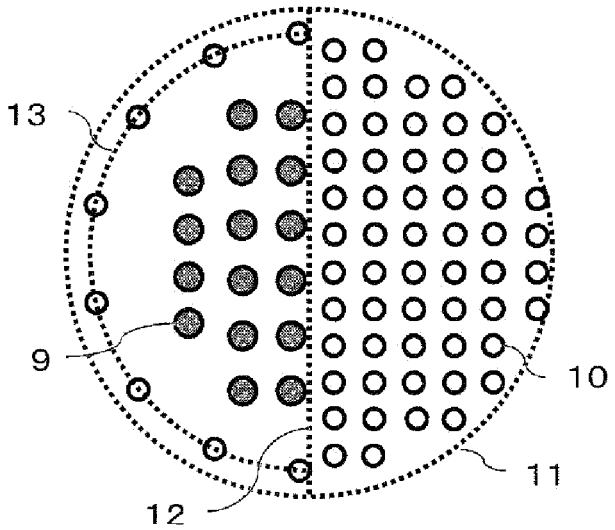

The "plurality of first component polymer distribution holes of semicircular arrangement" refers to an arrangement in which, as in the first component polymer distribution holes 9 in the polymer distribution hole group shown in FIG. 11A, in the outermost circumscribed circle 11 of the polymer distribution hole group, a straight line 12 can be drawn so that the straight line 12 bisects the outermost circumscribed circle 11 and the first component polymer distribution holes 9 are all included in one of the bisected semicircles. "All included in one of the semicircles" refers to a state in which the first component polymer distribution hole 9 exists inside the semicircle and on the straight line 12. An arrangement in which the straight line 12 cannot be drawn is referred to as a "circular arrangement."

The phrase "at least a part of the second component polymer distribution holes is arranged in semicircular arc arrangement on an outer side of a circumferential portion of the plurality of first component polymer distribution holes of semicircular arrangement" refers to an arrangement in which, as in the second component polymer distribution holes 10 in the polymer distribution hole group shown in FIG. 11A, all of the second component polymer distribution holes 10 in the semicircle including the first component polymer distribution hole 9 among the two semicircles formed by the straight line 12 and the outermost circumscribed circle 11 are on the outer side of the first component polymer distribution holes 9 and on the curve 13 along the circumferential direction of the semicircle. In FIG. 11A, the semicircular arc arrangement is one row, but may be any number of rows.

The principle described above will be described along with the flow form of the polymer. Both polymer flows of the first component polymer and the second component polymer are simultaneously discharged from the distribution hole 18 bored in the lowermost layer on the downstream side in the polymer spinning path direction of the distribution plate 15 toward the discharge introduction hole 19, each polymer flow widens in the direction perpendicular to the polymer spinning path direction, flows along the polymer spinning path direction, and the two polymers are joined to form a composite polymer flow. At this time, first, by disposing the plurality of first component polymer distribution holes 9 of the semicircular arrangement to be surrounded by the plurality of second component polymer distribution holes 10, a distance is generated between the centers of gravity of the polymers on the composite cross section of the composite fiber to be formed by discharging from the spinneret discharge holes, and the composite fiber can be bent toward the high shrinkage component side during the heat treatment to impart crimp-expressing property to the composite fiber. Furthermore, since the resistance received from the wall surface of the hole is constant in the composite polymer flow passing through the discharge introduction hole 19 and the asymmetry of the velocity distribution in the cross-sectional direction of the composite polymer flow can be alleviated, the bending on the high-viscosity polymer side of the composite polymer flow generated when discharged from the spinneret discharge hole 21 is reduced, and the discharge bending phenomenon can be inhibited.

Figure 13:
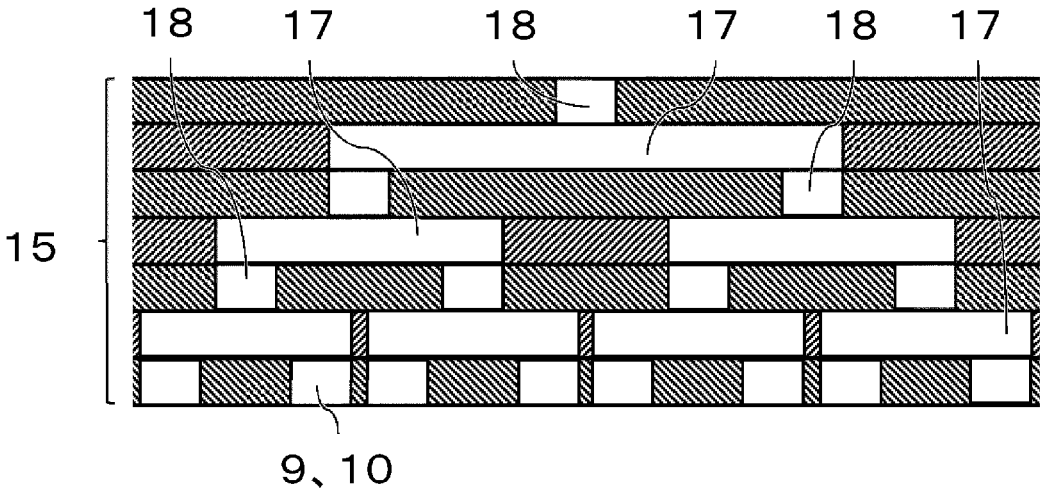
FIG. 13 is a schematic partial cross-sectional view of a distribution plate used in an example.

Further, in the distribution method of each polymer in the distribution plate 15, as shown in FIG. 13, it is preferable to use a tournament flow path constituting one distribution groove 17 with respect to one distribution hole 18. Since the distribution hole 18 for introducing the polymer flow to the downstream side is disposed at the end portion of the distribution groove 17, abnormal retention of the polymer is eliminated, the distribution of the polymer is high, and the polymer flows can be joined while precisely controlling the flow rate and the flow velocity in a wide discharge range. As a result, it is possible to form a stable flow with time without causing abnormal retention while precisely controlling the flow of the polymer amount, which is a problem when the polymer flows are joined in the conventional composite spinneret.

Further, when at least a part of the second component polymer distribution holes 10 is arranged in semicircular arc arrangement on the outer side of the circumferential portion of the plurality of first component polymer distribution holes 9 of semicircular arrangement, the composite cross section of the composite fiber obtained by discharging the composite polymer flow discharged to the discharge introduction hole 19 from the spinneret discharge hole can be the eccentric core-sheath cross section (see FIG. 11B) in which the side-by-side cross section is thinly coated with the composite fiber, and good crimp-expressing property can be expected. Further, as described above, by adopting the tournament method as shown in FIG. 13 as the distribution method of each polymer in the distribution plate 15, it is possible to precisely control the flow of an extremely small amount of polymer that forms the thin skin portion, and a stable flow can be formed with time without causing abnormal retention since the polymer retention portion of the conventional spinneret as in JP '175 is not required.

In the polymer distribution hole group bored in the lowermost layer on the downstream side in the polymer spinning path direction of the distribution plate 15, it is preferable that the total number of holes Ht of the second component polymer distribution holes 10 and the number of holes Ho of the second component polymer distribution holes 10 arranged in semicircular arc arrangement on the outer side of the circumferential portion of the plurality of first component polymer distribution holes 9 of semicircular arrangement satisfy relationship (1):

$$1/16 < Ho/Ht < 1/4 \quad (1).$$

Figure 8A:
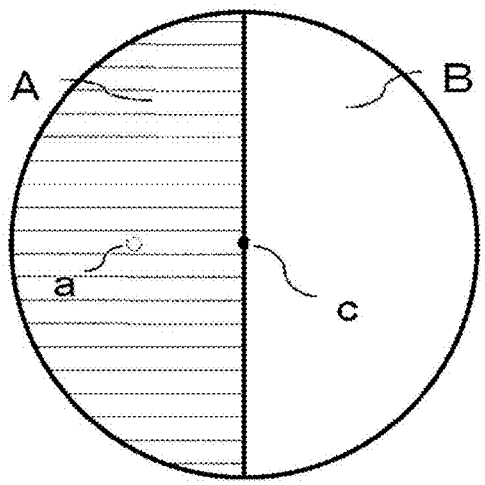
FIG. 8A PRIOR ART

By disposing the second component polymer distribution holes 10 to satisfy the relationship (1), it is possible to inhibit the discharge bending phenomenon in the spinneret discharge hole, and it is possible to obtain the composite fiber that exhibits the same degree of crimp-expressing property as the side-by-side cross section (refer to FIG. 8A).

Derivation of relationship (1) will be described in detail. The relationship between the total number Ht of the second component polymer distribution holes 10 in the polymer distribution hole group bored in the lowermost layer on the downstream side in the polymer spinning path direction of the distribution plate 15 and the number of holes Ho of the second component polymer distribution holes 10 arranged in semicircular arc arrangement on the outer side of the circumferential portions of the plurality of first component polymer distribution holes 9 of semicircular arrangement determines the thickness of the thin skin portion in the composite cross section of the composite fibers obtained by using our composite spinneret.

Figure 11B:
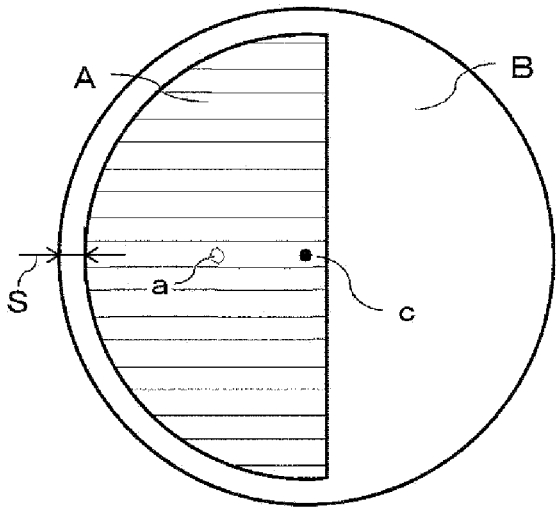

The "thickness of the thin skin portion" refers to the minimum thickness of the thicknesses of the second component polymer covering the first component polymer as indicated by the reference numeral "S" in FIG. 11B, for example.

When the value of Ho/Ht is smaller than ¼, the thickness of the thin skin portion becomes sufficiently small, and the distance between the center of the gravity point a of the first component polymer and the center point c of the composite fiber cross section is sufficiently increased so that it is possible to impart good crimp-expressing property to the obtained composite fiber. In particular, when the value of Ho/Ht is smaller than ⅙, the obtained composite fiber has a crimp-expressing property as much as that of the latent crimp-expressing fiber having the conventional side-by-side cross section and thus the range can be mentioned as a more preferable range.

On the other hand, as the thickness of the thin skin portion is thinner, the asymmetry of the velocity distribution in the cross-sectional direction of the composite polymer flow in the discharge introduction hole 19 is increased so that the effect of inhibiting the discharge bending phenomenon from the spinneret discharge hole is reduced. Therefore, to sufficiently obtain the effect of inhibiting the discharge bending phenomenon, it is preferable that the value of Ho/Ht is greater than 1/16. In particular, when the value is greater than 1/10, in which the composite cross section is formed by point discharge by the distribution hole group, it is possible to sufficiently provide the number of holes of the second component polymer distribution holes 10 arranged in semicircular arc arrangement to form the thin skin portion, and it is possible to obtain a uniform composite cross section without unevenness in the thin skin portion, and thus the range can be mentioned as a more preferable range.

In the discharge plate 16, it is preferable that a spinneret discharge hole that discharges the composite polymer flow is bored at a hole filling density of $1.0\times10^{-2}$ holes/mm$^2$ or more from the viewpoint of production efficiency and product variation.

The "hole filling density" refers to a value obtained by dividing the number of spinneret discharge holes in the composite spinneret by the spinneret area.

In the conventional composite spinneret, to form the eccentric core-sheath cross section, it is necessary to provide a separate flow path for the coating in addition to the flow path for joining the polymer flows. For this reason, it is necessary to increase the processing area of the introduction hole and the flow path for forming one fiber, and the hole filling density is at most $5.0\times10^{-3}$ holes/mm$^2$, and thus the number of fibers (the number of filaments) obtained from one composite spinneret is limited.

On the other hand, in our composite spinneret, since each polymer is distributed by the tournament flow path in the distribution plate 15 to form a composite cross section, the flow path for bonding the polymer flow and the flow path for the coating can be processed in the same flow path. For this reason, it is possible to extremely increase the hole filling density, which is a problem in known methods.

In our composite spinneret, it is possible to achieve a hole filling density of $1.0\times10^{-2}$ holes/mm$^2$ or more which cannot be achieved by a conventional composite spinneret. This means that the number of fibers obtained from one composite spinneret is twice or more, and the effect of improving the productivity can be sufficiently exhibited, which can be mentioned as a preferred range. From this viewpoint, it is possible to maintain the productivity equal to or higher than that of known devices in the manufacture of a so-called low-fineness product having a small fiber diameter obtained by decreasing the amount of the polymer per one spinneret discharge hole to obtain a soft feeling preferred for clothing applications, and it is more preferable that the hole filling density is $1.5\times10^{-2}$ holes/mm$^2$ or more as a range in which this can be achieved.

The higher the hole filling density, the more suitable for improving productivity and increasing product variations. However, if the size of the distribution hole, the distribution groove, or the discharge introduction hole is made too small to increase the hole filling density, there is a concern that clogging may occur due to the foreign matter or the like in the polymer when the composite fiber is manufactured, and the yarn manufacturing property may be deteriorated, and therefore, the practical upper limit is $5.0\times10^{-2}$ holes/mm$^2$.

Hereinafter, the composite spinneret illustrated in FIGS. 12A to 12C is sequentially described from the upstream side to the downstream side of the composite spinneret, along the flow of the polymer, from passing through the measurement plate 14 and the distribution plate 15 to form a composite polymer flow until the composite polymer flow is discharged from the spinneret discharge hole of the discharge plate 16.

The first component polymer and the second component polymer from the upstream of the spinning pack flow into a measurement hole 22*a* for the first component polymer and a second measurement hole 22*b* for the component polymer of the measurement plate, are measured by a hole throttle formed at a lower end, and then flow into the distribution plate 15. Each polymer is measured by a pressure loss due to a throttle provided in each measurement hole. The standard of the design of the diaphragm is that the pressure loss is 0.1 MPa or more. On the other hand, to inhibit distortion of the member due to excessive pressure loss, it is preferable to design the pressure loss to be 30.0 MPa or less. The pressure loss is determined by the inflow amount and the viscosity of the polymer for each measurement hole. For example, when melt spinning is performed using a polymer having a temperature of 280° C. and a strain rate of 1000 s$^{-1}$ and a viscosity of 100 to 200 Pa·s under a spinning temperature of 280° C. to 290° C. and a discharge amount of each of the measurement holes of 0.1 g/min to 5.0 g/min, it is possible to discharge with good measurement performance when the throttle of the measurement hole diameter has a hole diameter of 0.01 mm to 1.00 mm and L/D (discharge hole length/discharge hole diameter) of 0.1 to 5.0. When the melt viscosity of the polymer is smaller than the viscosity range or the discharge amount of each hole is reduced, the hole diameter may be reduced to approach the lower limit of the above range or the hole length may be extended to approach the upper limit of the above range. On the contrary, when the viscosity is high or the discharge amount is increased, the hole diameter and the hole length may be regulated reversely.

In addition, it is preferable to stack a plurality of measurement plates 14 to measure the amount of the polymer in a stepwise manner, and it is more preferable to provide the measurement holes separately from two stages to ten stages. The action of dividing the measurement plate or the measurement hole into a plurality of times is suitable for controlling a minute amount of polymer on $10^{-5}$ g/min/hole order which is lower by several orders of magnitude than the condition used in the related art.

The polymer discharged from each of the measurement holes 22*a*, 22*b* flows into the distribution groove 17 of the distribution plate 15 separately. In the distribution plate 15, the distribution groove 17 for collecting the polymer flowing in from each of the measurement holes 22*a*, 22*b* is provided and a distribution hole 18 for allowing the polymer to flow downstream is bored in the lower surface of the distribution groove 17. It is preferable that a plurality of distribution holes 18 having two or more holes are bored in the distribution groove 17.

Further, as illustrated in FIG. 13, the distribution plate 15 may be a tournament flow path in which one distribution groove corresponds to one distribution hole 18, or may be a tournament flow path in which one distribution groove corresponds to the plurality of distribution holes 18 and each polymer is individually joined and distributed in a part thereof. When a flow path is designed so that repetition such as a plurality of distribution holes 18, a distribution groove 17, and a plurality of distribution holes 18 is performed, the polymer flow can flow into another distribution hole. For this reason, even when the distribution hole 18 is partially closed, the missing portion is filled in the downstream distribution groove 17. Further, by boring the plurality of distribution holes 18 in the same distribution groove 17 and repeating this, even when the polymer of the closed distribution hole 18 flows into another hole, the influence thereof substantially vanishes. Further, since the polymer which has passed through various flow paths, that is, has undergone various thermal history joins in the distribution groove 17 multiple times to homogenize the viscosity, it is also great in terms of reducing the variation in the viscosity. In particular, in the composite fiber, maintaining the dimensional stability of the composite cross section at a high level leads to the yarn manufacturing stability. Therefore, consideration for the thermal history and the viscosity variation is effective.

Further, in designing to repeat such a distribution hole 18, the distribution groove 17 and the distribution hole 18, a structure in which the downstream distribution groove is disposed at an angle of 1° to 179° in the circumferential direction with respect to the upstream distribution groove and the polymers flowing from the different distribution groove are joined is effective for controlling the composite cross section, because the polymers having undergone different heat histories or the like are joined a plurality of times. In addition, the mechanism for joining and distributing is preferably employed from the upstream portion, and is also preferably applied to the measurement plate 14 and the upstream member thereof for the purpose described above. The composite spinneret having such a structure forms a stable flow with time without causing abnormal retention while precisely controlling the flow of the extremely small amount of polymer as described above, and it is possible to manufacture a composite fiber which can maintain the dimensional stability of the composite cross section required at a high level regardless of the discharge range.

The cross-sectional shape of the composite fiber can be controlled by the arrangement of the distribution holes bored in the lowermost layer on the downstream side in the polymer spinning path direction of the distribution plate 15 immediately above the discharge plate 16. At this time, to improve the accuracy of the cross-sectional shape, the first component polymer and the second component polymer are distributed to a very large number in the lowermost layer on the downstream side in the polymer spinning path direction of the distribution plate 15 immediately above the discharge plate 16 so that the discharge amount for each distribution hole is extremely small. As a result, the pressure loss applied to the distribution holes also becomes extremely small from the level of $10^{-2}$ MPa to $10^{-5}$ MPa. Therefore, to inhibit the interference between the polymers, it is preferable to adjust the hole diameters of the first component polymer distribution holes 9 and the second component polymer distribution holes 10 and control the discharge velocity of the polymer flow discharged from each of the distribution holes.

In a preferred range of the flow velocity ratio, when the discharge velocity of the first component polymer per a single distribution hole is represented by $F_1$ and the discharge velocity of the second component polymer is represented by $F_2$, the ratio ($F_1/F_2$ or $F_1/F_2$) thereof is preferably 0.05 to 20, and more preferably 0.1 to 10. In this range, the composite polymer flow in which the polymers discharged from the distribution holes bored in the lowermost layer on the downstream side in the polymer spinning path direction of the distribution plate 15 immediately above the discharge plate 16 do not interfere with each other is guided to the reduction hole 20 through the discharge introduction hole 19 as a laminar flow so that the cross-sectional shape is stabilized, and the shape can be maintained with high accuracy.

To achieve the composite fiber, it is preferable that the melt viscosity ratio ($V_1/V_2$) between the melt viscosity $V_1$ of the first component polymer and the melt viscosity $V_2$ of the second component polymer is 1.1 to 15.0 in addition to the use of such a novel composite spinneret.

The term "melt viscosity" refers to a melt viscosity measured by a capillary rehome-ter for a chip-shaped polymer processed by a vacuum dryer to have a moisture content of 200 ppm or less, and refers to a melt viscosity at the same shear velocity at a spinning temperature.

Although the cross-sectional shape of the composite fiber is basically controlled by the arrangement of the distribution holes, the polymers are joined together to form a composite polymer flow, and then the composite polymer flow is significantly reduced in the cross-sectional direction by the reduction hole 20. Therefore, the melt viscosity ratio at that time, that is, the rigidity ratio of the molten polymer may affect the formation of the cross section. For this reason, $V_1/V_2$ is more preferably 2.0 to 12.0. In particular, the rigidity of the polymer is high in the first component polymer which is a high shrinkage component, and is low in the second component polymer which is a low shrinkage component. Thus, in the elongation deformation in the yarn manufacturing process and the high-order processing process, the stress is preferentially applied to the first component polymer which is a high shrinkage component. For this reason, the high shrinkage component has a high orientation and the shrinkage difference is increased so that more advanced crimping can be exhibited, which is also suitable from the viewpoint of the crimp-expressing property of the composite fiber.

From the viewpoint of inhibiting the discharge bending phenomenon in the spinneret discharge hole of the composite polymer flow, $V_1/V_2$ is preferably close to 1. However, also considering the above-mentioned crimp-expressing property, $V_1/V_2$ is particularly preferably 2.0 to 8.0.

The melt viscosity of the polymer described above can be relatively freely controlled by adjusting the molecular weight and the copolymerization component even with the same kind of polymer. Therefore, the melt viscosity is used as an index for a combination of polymers and a setting of the spinning condition.

The composite polymer flow discharged from the distribution plate 15 flows into the discharge plate 16. It is preferable that the discharge plate 16 is provided with the discharge introduction hole 19. The discharge introduction hole 19 allows the composite polymer flow discharged from the distribution plate 15 to flow perpendicularly to the discharge surface for a certain distance. This intends to alleviate the flow velocity difference between the first component polymer and the second component polymer, and to reduce the flow velocity distribution in the cross-sectional direction of the composite polymer flow. Since at least two or more kinds of polymers are used as a composite polymer flow, it is preferable to provide the discharge introduction hole 19 from the viewpoint of discharge stability such as a cross-sectional shape and a prevention of a discharge bending phenomenon.

To reduce the flow velocity distribution, it is preferable to control the flow velocity of the polymer itself by the discharge amount, the hole diameter, and the number of holes in the distribution hole 18 of each polymer, and it is preferable to design the discharge introduction hole 19 with $10^{-1}$ seconds to 10 seconds (=the discharge introduction hole length/the polymer flow velocity) as a standard before the composite polymer flow is introduced into the reduction hole 20, from the viewpoint that the alleviation of the flow velocity ratio is substantially completed. Within this range, the distribution of the flow velocity is sufficiently alleviated, and the effect is exhibited in improving the stability of the cross section.

Next, the composite polymer flow is reduced in the cross-sectional direction along the polymer flow by the reduction holes 20 during introduction into the discharge holes having a desired diameter. The flow line of the middle layer of the composite polymer flow is substantially linear, but the outer layer is more largely bent. To obtain the composite fiber, it is preferable to reduce the size without changing the cross-sectional shape of the composite polymer flow constituted by innumerable polymer flows including the first component polymer and the second component polymer. Therefore, it is preferable that the angle of the hole wall of the reduction hole 20 is 30° to 90° with respect to the discharge surface.

As described above, the composite polymer flow passes through the discharge introduction hole 19 and the reduction hole 20 and is discharged from the spinneret discharge hole 21 to the spinning line while maintaining the cross-sectional shape of the distribution hole 18. The spinneret discharge hole 21 has a purpose of controlling the flow rate of the composite polymer flow, that is, measuring the discharge amount again and controlling the draft (=take-up velocity/discharge line velocity) on the spinning line. The hole diameter and the hole length of the spinneret discharge hole 21 are preferably determined in consideration of the viscosity and the discharge amount of the polymer. In the manufacture of our composite fiber, it is preferable to select the discharge hole diameter D of 0.1 mm to 2.0 mm and L/D (discharge hole length/discharge hole diameter) of 0.1 to 5.0.

The composite fiber can be manufactured by using the composite spinneret as described above, and in view of productivity and simplicity of equipment, it is preferable to perform by melt spinning.

When the melt spinning is selected, examples of the first component polymer and the second component polymer include melt-moldable polymers such as polyethylene terephthalate, polyethylene naphthalate, polybutylene terephthalate, polytrimetylene terephthalate, polypropylene, polyolefin, polycarbonate, polyacrylate, polyamide, polylactic acid, thermoplastic polyurethane, and polyphenylene sulfide, and copolymers thereof. In particular, it is preferable that the melting point of the polymer is 165° C. or more because the heat resistance is good. In addition, various additives such as inorganic such as titanium oxide, silica, and barium oxide, carbon black, colorants such as dyes and pigments, flame retardants, fluorescent brighteners, antioxidants, and ultraviolet absorbers may be contained in the polymer.

The combination of the first component polymer (high shrinkage component) and the second component polymer (low shrinkage component) is preferably a combination of polymers causing a shrinkage difference when heat treatment is performed. From such a viewpoint, a combination of polymers having a difference in molecular weight or composition to such a degree that a viscosity difference of 10 Pa·s or more occurs at a melt viscosity is preferable.

As specific examples of the combination of the polymers, using polyethylene terephthalate, polyethylene naphthalate, polybutylene terephthalate, polytrimethylene terephthalate, polyamide, polylactic acid, thermoplastic polyurethane, polyphenylene sulfide or the like, by changing the molecular weight of the first component polymer and the second component polymer, or using one as a homopolymer and using the other as a copolymer are preferred from the viewpoint of inhibiting peeling. In addition, from the viewpoint of improving the crimp-expressing property, a combination of different polymer compositions is preferred, and examples of the first component polymer/the second component polymer include various combinations such as polybutylene terephthalate/polyethylene terephthalate, polytrimethylene terephthalate/polyethylene terephthalate, thermoplastic polyurethane/polyethylene terephthalate, polyester elastomer/polyethylene terephthalate, polyester elastomer/polybutylene terephthalate as polyester-based resins, nylon 6-nylon 66 copolymer/nylon 6 or 610, PEG-copolymerized nylon 6/nylon 6 or 610, thermoplastic polyurethane/nylon 6 or 610 as polyamide-based resins, and ethylene-propylene rubber fine dispersed polypropylene/polypropylene, propylene-α-olefin copolymer/polypropylene as a polyolefin-based resin. In particular, a combination of a polyester-based resin and a polyamide-based resin is preferable since it is not only capable of expressing a fine condensation form but also excellent in color developability, texture, wear resistance, dimensional stability or the like.

The spinning temperature in the manufacture method is preferably a temperature at which a polymer having a high melting point or a high viscosity among the use polymers determined from the viewpoint described above exhibits fluidity. The temperature indicating the fluidity varies depending on the polymer properties and the molecular weight thereof, but the melting point of the polymer may be a standard, and may be set to be equal to or lower than the melting point +60° C. When the temperature is equal to or lower than the above temperature, a decrease in molecular weight is inhibited without thermal decomposition of the polymer in the spinning head or the spinning pack, and composite fibers can be favorably manufactured.

The discharge amount of the polymer in the manufacture method may be 0.1 g/min/hole to 20.0 g/min/hole per discharge hole as a range in which the polymer can be melted and discharged while maintaining the stability. At this time, it is preferable to consider the pressure loss in the discharge hole in which the discharge stability can be secured. The pressure loss mentioned here is preferably 0.1 MPa to 40 MPa as a standard, and the discharge amount is preferably determined from the relationship with the melt viscosity, the discharge hole diameter, and the discharge hole length of the polymer.

The ratio of the first component polymer and the second component polymer in spinning the composite fibers used in the manufacture method is preferably selected 30/70 to 70/30 in terms of weight ratio based on the discharge amount. Within this range, long-term stability of the composite cross section and the composite fiber can be efficiently and well-balanced while maintaining stability. In addition, 40/60 to 60/40 is more preferred as a range in which the distance between the center of the gravity point a and the center point c is sufficiently long and a good crimp-expressing property can be realized.

The polymer flow melted and discharged from the discharge hole is cooled and solidified, is converged by applying an oil agent or the like, and taken up by a roller whose peripheral velocity is prescribed. The take-up velocity is determined from the discharge amount and the target fiber diameter. From the viewpoint of stably manufacturing the composite fiber, the take-up velocity of the roller may be about 500 m/min to 6000 m/min, and can be changed depending on the physical properties of the polymer and the intended use of the fibers. The spun composite fiber is preferably drawn from the viewpoint of not only improving the mechanical properties by promoting the uniaxial orientation of the fiber, but also obtaining the good crimping property by increasing the difference in heat shrinkage caused by the difference in stress during drawing and the difference in orientation during drawing between the composite polymers. Regarding drawing, the spun composite fiber may be once wound and then drawn, or may be drawn continuously after spinning without being wound once. In addition to the drawing, a false twisting process may be added.

As the drawing condition, for example, in a drawing machine including a pair of rollers, if the fiber is a fiber made of a polymer exhibiting a thermoplastic property that can be generally melt-spun, the fibers are reasonably extended in the fiber axis direction due to the peripheral velocity ratio of the first roller set to a temperature equal to or higher than the glass transition temperature and equal to or lower than the melting point and the second roller set to a temperature corresponding to the crystallization temperature, and are heat-set and wound. In addition, in a polymer which does not exhibit glass transition, the dynamic viscoelasticity measurement (tan δ) of the composite fiber may be performed, and the temperature equal to or higher than the peak temperature on the high temperature side of the obtained tan δ may be selected as the preheating temperature. From the viewpoint of increasing the draw ratio and improving mechanical properties and latent crimping property, it is also preferable to perform this drawing process in multiple stages. When the composite fiber is manufactured by the manufacture method as described above, as shown in FIG. 6B, a thin skin eccentric core-sheath cross section fiber configured by a uniform thin skin in which a part of the fiber cross section is composed of a sheath component is formed, which can be mentioned as a more preferable cross-sectional shape. In a particularly preferable form of the thin skin eccentric core-sheath cross section fiber, the ratio S/D of the thickness S which is the minimum thickness of the component covering the core component to the fiber diameter D is 0.01 to 0.10, and the peripheral length portion (S ratio) having a thickness within 1.05 times the minimum thickness S accounts for 30% or more of the entire perimeter of the fiber cross section. With this range, the distance between the center of gravity points that affect the crimping can be set with a high degree of freedom, and a wide control width of the coil diameter of the latent crimping of the fibers can be ensured.

To obtain a state in which two or more kinds of crimping coexist in a multifilament, which is a feature of the stretch yarn, various methods can be used: a method of changing the distance between the centers of gravity between the components by using the eccentric core-sheath cross section fibers, a method of changing the fiber diameter of each fiber of the eccentric core-sheath cross section fiber, a method of applying the false twisting process to the eccentric core-sheath cross section fiber to impart the actualized crimping in addition to the latent crimping, a method of post-mixing two or more kinds of eccentric core-sheath cross section fibers having different coil diameters or the like. By forming a multifilament in a state in which a fiber having a large coil diameter is partially entangled with a fiber having a small coil diameter, the fiber having a large coil diameter is partially deformed to follow the elongation deformation of the fiber having a small coil diameter, and from the viewpoint of excellent elongation deformation in the entire multifilament, a method of changing the fiber diameter for each fiber of the thin skin eccentric core-sheath cross section fibers or a method of performing false twisting process on the thin skin eccentric core-sheath cross section fibers is preferably used.

When our stretch yarn is obtained by a method of changing the fiber diameter for each fiber of the eccentric core-sheath cross section fiber, it is preferable that "two or more kinds of the eccentric core-sheath composite fibers having different fiber diameters coexist in the multifilament."

The state of "two or more kinds of the eccentric core-sheath composite fibers having different fiber diameters coexist in the multifilament" refers to a state having two or more fiber diameter distributions when yarn bundle cross sections for all the single fibers are evaluated in terms of the fiber diameter described above. When two kinds of eccentric core-sheath composite fibers having different fiber diameters exist in the multifilament, two fiber diameter distributions (5-(*a*), 5-(*c*)) as illustrated in FIG. 5 are obtained.

Figure 5:
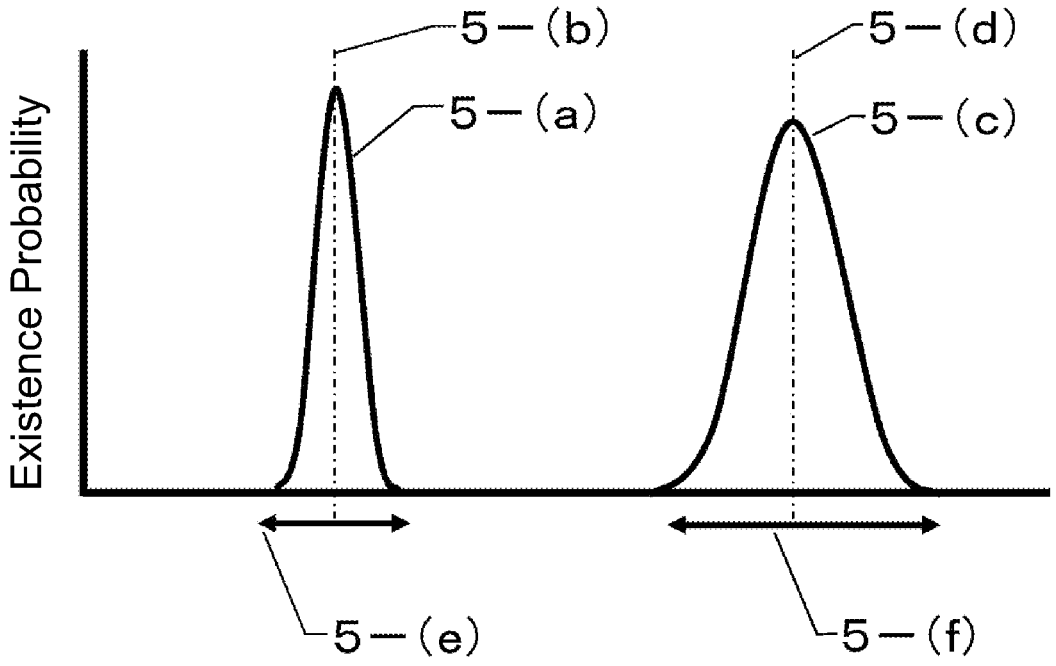
FIG. 5 illustrates an example of a fiber diameter distribution of fibers constituting our stretch yarn.

That is, the single fiber group having a fiber diameter that falls within the range of each distribution (distribution width) is defined as "one kind," and in the measurement results of all the fibers constituting the latent crimping yarn, two or more of the fiber diameter distributions existing as shown in FIG. 5 means that "two or more kinds of eccentric core-sheath composite fibers having different fiber diameters exist in the yarn bundle." The distribution width (5-(*e*), 5-(*f*)) of the fiber diameter means a range of ±5% of the central fiber diameter (5-(*b*), 5-(*d*)) which is the peak value having the largest number in each single fiber group.

When the eccentric core-sheath composite fiber is crimped by heat treatment or the like, a plurality of crimping forms having different coil diameters coexist in the multifilament because a crimping form depends on the fiber diameter. That is, the ratio (Dmax/Dmin) of the maximum value (Dmax) to the minimum value (Dmin) of the center fiber diameter of the fibers constituting the multifilament is preferably 1.20 or more.

The fiber diameter and the ratio of the center fiber diameter (Dmax/Dmin) can be determined as follows.

First, a latent crimping yarn is embedded with an embedding agent such as an epoxy resin, and images of all the single fibers are captured at a magnification at which ten or more single fibers can be observed with a scanning electron microscope (SEM) (for example, a scanning electron microscope manufactured by KEYENCE CORPORATION, model number "VE-7800 type") for this cross section. In each captured image, the cross-sectional area Af of the single fiber is measured using image analysis software (for example, "WinROOF 2015" manufactured by MITANI CORPORATION), the diameter of a perfect circle having the same area as the cross-sectional area Af is calculated with the unit of and the fiber diameter is calculated by rounding off to the first decimal place. This measurement is carried out on all of the single fibers constituting the latent crimping yarn, the distribution of the fiber diameter as shown in FIG. 5 is created from the results, the single fibers are classified for each fiber diameter, and then the distance between the central center of gravity points which is the peak value having the largest number in each single fiber group is obtained. Based on this result, the ratio (Dmax/Dmin) of the center fiber diameter is calculated using the maximum center fiber diameter (Dmax) and the minimum center fiber diameter (Dmin) in the latent crimping yarn.

When Dmax/Dmin is 1.20 or more, it is possible to form a multifilament in a state in which a fiber having a small coil diameter is partially entangled with a fiber having a large coil diameter. It is possible to obtain a stretch yarn that is deformed such that a fiber having a large coil diameter partially follows the elongation deformation of a fiber having a small coil diameter, which is desired effect. Further, when Dmax/Dmin is 1.30 to 2.00, a crimping phase shift occurs between the fibers, and the elongation-stress curve of the multifilament does not become stepwise deformation so that a stretch yarn having good elongation energy can be obtained. Thus, it can be mentioned as a more preferable range.

In addition, in obtaining our stretch yarn by the method of subjecting the thin skin eccentric core-sheath cross-section fiber to the false twisting process, it is possible to easily change the size of the actualized crimping added depending on the processing condition and, when the processing conditions are determined according to the size of the latent crimping, it is possible to control the specific coil diameter distribution which is the requirement of the stretch yarn.

Further, in the stretch yarn obtained by the false twisting process, the crimp size in the fiber longitudinal direction is not uniform, and latent/actualized crimping exists randomly, and therefore the fibers do not converge in each crimp size. For this reason, it is possible to inhibit the separation of the multifilament as seen by a stretch yarn or the like prepared by post-blending or the like, and it is possible to obtain the stretch yarn with good quality since the handleability and the process passability in the high order process are excellent.

To stably manufacture the stretch yarn by utilizing the false twisting process, it is preferable to control the coil diameter size of the actualized crimping of the textured yarn by the number of actual twists of the multifilament in the twisted region.

That is, it is preferable to set the false twisting conditions such as the number of rotations and the processing velocity of the twisting mechanism so that the false twist number T (unit: number/m) which is the number of twists of the multifilament in the twisting region satisfies conditions determined depending on the total fineness Df (unit: dtex) of the multifilament after the false twisting process:

$$20000/Df^{0.5} \leq T \leq 40000/Df^{0.5}.$$

The false twist number T is determined as follows: the multifilament running in the twisted region of the false twisting process is collected at a length of 50 cm or more to not untwist the multifilament immediately before the twister; and the false twist number is obtained by attaching the collected yarn sample to a twisting machine to not untwist and measuring the actual twist number by the method described in JIS1013 (2010) 8.13. When the false twist number satisfies the above conditions, the coil diameter of the actualized crimping can be finely controlled in the obtained multifilament, and the characteristic coil diameter distribution of our stretch yarn can be achieved.

In addition, in the above-mentioned false twisting conditions, to impart uniform crimping to the entire fibers in the multifilament and to obtain the textured yarn with good quality, it is preferable to adjust the draw ratio in the twisted region. The draw ratio is calculated as Vd/V0 by using the peripheral velocity V0 of the roller that supplies the yarn to the twisted region and the peripheral velocity Vd of the roller disposed immediately after the twisting mechanism, and is preferably determined according to the characteristics of the yarn to be supplied.

In using the drawn eccentric core-sheath fiber as the supply yarn, the Vd/V0 may be 0.9 to 1.4 times, and in using the non-drawn eccentric core-sheath fiber as the supply yarn, the drawing may be performed simultaneously with the false twisting process by setting Vd/V0 to 1.2 to 2.0 times. Due to the draw ratio within such a range, it is possible to apply uniform crimping to the entire fibers in the multifilament, without causing excessive tension in the twisted region or generating sagging of the multifilament.

Further, from the viewpoint of firmly fixing the actualized crimping, the false twisting temperature is preferably determined from Tg+50° C. to Tg+150° C. based on the glass transition temperature (Tg) of the sheath component polymer. The false twisting temperature used herein refers to the temperature of the heater installed in the twisted region. Due to the false twisting temperature in such a range, the sheath component which is largely twisted and deformed in the fiber cross section can be sufficiently fixed in structure so that the dimensional stability of the actualized crimping is good, and a fabric with good quality without wrinkles or streak can be obtained. The Tg of the sheath component is measured by differential scanning calorimetry (DSC) of a chip of the polymer used for the sheath component. It is preferable to use a one-heater method in which the heater is disposed only in the twisted region to fix the actualized crimping and achieve the characteristic coil diameter distribution of the stretch yarn.

By performing the false twisting process under the above conditions, it is possible to control the coil diameter of the actualized crimping of the multifilament with respect to the coil diameter of the latent crimping to fall within a suitable range in which the desired effect can be expressed, and thus it is possible to manufacture the stretch yarn with high quality.

As described above, the method of manufacturing the stretch yarn has been described based on a typical melt spinning method, but it goes without saying that the yarn can be manufactured by a melt blow method and a spun bond method, and the yarn can also be manufactured by a solution spinning method such as a wet and dry-wet method.

EXAMPLES

Hereinafter, our stretch yarn will be specifically described with reference to Examples.

For Examples and Comparative Examples, the following evaluations were performed.

A. Fineness

The weight of the fiber of 100 m was measured, and a value obtained by multiplying the measured value by 100 was calculated. This operation was repeated 10 times, and a value obtained by rounding off to the first decimal place of the average value was defined as a total fineness (dtex). The value obtained by dividing the above total fineness by the number of filaments is a single fiber fineness (dtex).

B. Strength of Fibers and Elongation at Break

The sample was measured with a tensile tester ("TENSILON" (TENSILON) UCT-100, manufactured by Orientec Co., Ltd.) under constant velocity elongation conditions shown in JIS L1013 (2010) 8.5.1 standard time test. The gripping interval at this time was 20 cm, the tensile rate was 20 cm/min, and the number of tests was 10. The elongation at break was determined from the elongation of the point at which the maximum strength in the elongation-stress curve was exhibited.

C. Coil Diameter Distribution of Multifilament and Ratio of Maximum Group Average Value and Minimum Group Average Value A 10-meter skein of the stretch yarn was prepared by using a sizing reel or the like, immersed in boiling water of 98° C. or more with a load of 0.2 mg/d, and subjected to a boiling water treatment for 15 minutes. After the treated yarn was sufficiently dried by air drying, the treated yarn was applied with a load of 1 mg/d for 30 seconds or more, and then two points were marked on any part of the multifilament such that the distance between the two points was 3 cm. Thereafter, the fiber was separated from the multifilament to not be plastically deformed, and the fiber was fixed on the slide glass by adjusting the distance between the markings set in advance to be 3 cm as the original, and an image of the sample was captured at a magnification at which five to ten peaks of crimping can be observed with a VHX-2000 digital microscope manufactured by KEYENCE CORPORATION. In each of the captured images, the coil diameter was measured up to the first decimal place with a unit μm.

The same operation was randomly performed on different fibers constituting the multifilament, and this operation is repeated to measure the coil diameter such that the total number of data became 100.

These measured values were divided into classes with a boundary value of 10×n (n: natural number) μm and a width of 10 μm, and a histogram in which the vertical axis represents a frequency was created.

In the histogram, a group average value was calculated by simply averaging the coil diameters included in each group.

Based on the results, among all group average values included in the coil diameter distribution, the ratio was calculated by dividing the maximum one by the minimum one. The ratio of the maximum group average value to the minimum group average value is rounded off to the second decimal place.

D. Average Diameter of Fibers

The stretch yarn was embedded with an embedding agent such as an epoxy resin, and images were captured for all the fibers at a magnification at which ten or more fibers can be observed with a VE-7800 scanning electron microscope (SEM) manufactured by KEYENCE CORPORATION in this cross section. In each captured image, the cross-sectional area Af of the fiber was measured using image analysis software ("WinROOF 2015" manufactured by Mitani Co., Ltd.), and the diameter of a perfect circle having the same area as the cross-sectional area Af was calculated. This was measured for all the fibers constituting the multifilament, and the average diameter of the fibers was calculated by obtaining a simple number average. The average diameter of the fibers with a unit of μm is rounded off to the second decimal place.

E. Elongation Energy in Tensile Properties

The stretch yarn was left to stand under no load for 24 hours at a temperature of 20±2° C. and a relative humidity of 65±2%. After the lapse of 30 seconds or more by applying a load of 1 mg/d to the yarn sample after standing for 24 hours, the yarn sample was fixed to a "TENSILON" (TENSILON) UCT-100 tensile tester manufactured by Orientec Co., Ltd. with the initial sample length set to 50 mm with the load applied. The tensile test of the yarn sample was performed at a tensile velocity of 50 mm/min, and an elongation-stress curve was created as illustrated in FIG. 4 with the horizontal axis as elongation (unit: mm) and the vertical axis as stress (unit: cN/dtex). In the obtained elongation-stress curve, an area Ae surrounded by a point where the strength was 0.05 cN/dtex (4-(*a*) in FIG. 4), an intersection (4-(*b*) in FIG. 4) of a perpendicular line drawn from the point toward the horizontal axis (stress is 0 cN/tex) and the horizontal axis, and the origin was determined. The elongation energy was calculated by obtaining a simple number average of the results determined for ten different yarn samples. The elongation energy with a unit of μJ/dtex is rounded off to the first decimal place.

F. Fabric Evaluation (Motion Followability, Adhesiveness)

A stretch yarn was used for the weft yarn and the warp yarn, a plain woven fabric was prepared at a weft density of 90 cords/inch, refining was performed at 80° C. for 20 minutes, an intermediate set at 180° C. for 1 minute was performed, and a relaxation treatment was performed at 120° C. for 20 minutes.

The fabric sample prepared as described above was evaluated by ten skilled persons in the following three steps with respect to the motion followability when deformation was applied to the woven fabric from the extension during elongation in the weft yarn direction and the resistance during elongation.

In addition, in the rubbing between the skin and the fabric when the fabric was elongated, the adhesiveness to the skin was evaluated in the following three stages.

Regarding the motion followability and the adhesiveness, A was set to 5 points, B was set to 2 points, and C was set to 0 point. The evaluation was "A" when the total score of 10 skilled persons was 30 points or more, the evaluation was "B" when the total score was 10 points to 29 points, and the evaluation was "C" when the total score was 9 points or less. Evaluation "A" and "B" are acceptable.

A: An appropriate resistance feeling is provided, and extension is large.

B: Although the resistance feeling is slightly smaller or slightly larger, the extension is large.

C: There is insufficient resistance feeling during elongation or excessive resistance feeling during elongation.

G. Wear Resistance

The wear resistance of the fabric prepared by the above F. was evaluated according to JIS L1096 (2010) 8.19: E method (Martindale method).

H. Composite Spinneret (Distribution Type Spinneret)

Among Examples 12 to 20 and Comparative Examples 4 to 9, when the composite spinneret was a distribution type spinneret, the arrangement of the first component polymer distribution holes in the polymer distribution hole group bored in the lowermost layer on the downstream side in the polymer spinning path direction of the distribution plate was evaluated. At this time, in the outermost circumscribed circle of the polymer distribution hole group, an arrangement in which a straight line can be drawn so that the straight line bisects the outermost circumscribed circle and the first component polymer distribution holes are all included in one of the bisected semicircles was defined as a semicircular arrangement. The phrase "all included in one of the semicircles" refers to a state in which the first component polymer distribution holes exist inside the semicircle or on the straight line. An arrangement in which any of the straight line cannot be drawn was defined as a circular arrangement.

In addition, with respect to the number of holes of the second component polymer distribution holes in the polymer distribution hole group, the number of holes Ho of the second component polymer distribution holes arranged in the semicircular arc arrangement on the outer side of the circumferential portions of the plurality of first component polymer distribution holes in the semicircular arrangement was evaluated. At this time, the outermost circumscribed circle was bisected into two semicircles by a straight line so that the outermost circumscribed circle of the polymer distribution hole group is bisected and the first component polymer distribution holes can be included in one of the bisected semicircles, and the number of holes of the second component polymer distribution holes on a curve parallel to the circumferential direction of the semicircle in the semicircle in which the first component polymer distribution hole is included is set as the number of holes Ho of the second component polymer distribution hole arranged in the semicircular arc arrangement on the outer side of the circumferential portion of the plurality of first component polymer distribution holes in the semicircular arrangement. Ho/Ht was calculated by dividing Ho by the total number of holes Ht of the second component polymer distribution holes in the polymer distribution hole group.

I. Composite Spinneret (Hole Filling Density)

In Examples 12 to 20 and Comparative Examples 4 to 9, a value obtained by dividing the number of spinneret discharge holes of the composite spinneret by the spinneret area was defined as a hole filling density (holes/$mm^2$).

J. Melt Viscosity and Viscosity Ratio of Polymer

The chip-shaped polymer was dried by a vacuum dryer at a moisture content of 200 ppm or less, and the melt viscosity was measured by changing the strain rate stepwise by a capilograph manufactured by Toyo Seiki Seisaku-sho Co., Ltd. The measurement temperature was the same as the spinning temperature, and the measurement was started 5 minutes after the sample was put into the heating furnace under a nitrogen atmosphere, and the value of the shear rate of 1216 $s^{-1}$ was evaluated as the melt viscosity of the polymer. Further, a value obtained by rounding off a value obtained by dividing the melt viscosity of the first component polymer by the melt viscosity of the second component polymer to the first decimal place was defined as a viscosity ratio (V1/V2).

K. Discharge Stability

In Examples 12 to 20 and Comparative Examples 4 to 9, the yarn manufacturing was performed, and an image of the polymer flow discharged from the spinneret discharge hole was captured by a camera from 300 mm below the spinneret surface and an angle of 45° from the vertical line of the spinneret surface, and the discharge stability was evaluated from the discharge bending angle of the polymer flow with respect to the normal direction of the spinneret surface in the captured image based on three grades:

Extremely good A: less than 45°

Good B: 45° or more and less than 60°

Defective C: 60° or more.

L. Yarn-Manufacturing Stability

The yarn-manufacturing was performed for Examples 12 to 20 and Comparative Examples 4 to 9, and the yarn-manufacturing stability was evaluated from the number of yarn breakage per 10 million m based on three grades:

Extremely good A: Less than 0.8 times/10 million m

Good B: 0.8 times/10 million m or more and less than 2.0 times/10 million m

Defective C: 2.0 times/10 million m or more.

M. Cross Section (Composite Cross Section, Thickness Proportion of Thin Skin Portion, Thickness Variation of Thin Skin Portion)

After the fiber was embedded in an embedding agent such as an epoxy resin, the image was captured as a magnification at which ten or more fibers can be observed with a transmission electron microscope (TEM) in this cross section, and the composite cross section was observed. At this time, the contrast of the joint portion of the composite cross section was clarified by utilizing the fact that the dyeing difference between the polymers could be obtained by metal dyeing.

When the composite cross section of the captured image was the eccentric core-sheath cross section as shown in FIG. 11B, for ten or more fibers randomly extracted in the same image from each image, the thickness of the thin skin portion representing the minimum thickness of the sheath component covering the core component (reference numeral "S" in FIG. 11B) and the fiber diameter representing the width of the fiber in the direction perpendicular to the fiber axis were obtained with a unit of μm, and the value obtained by dividing the thickness of the thin skin portion by the fiber diameter was calculated. When a simple number average of the results performed in ten fibers different from each other is obtained, a value rounded off to the first decimal place is defined as the thickness proportion of the thin skin portion, and a standard deviation CV % (coefficient of variation) of the thickness of the thin skin portion in the ten fibers was defined as the thickness variation of the thin skin portion.

N. Crimp-Expressing Property

In Examples 12 to 20 and Comparative Examples 4 to 9, a yarn manufacturing was performed, and the crimp-expressing property was evaluated in three steps from the stretch-elongation ratio of the obtained composite fiber (JIS L1013 (2010) 8.11: C method (simple method)):

Extremely good A: 60% or more

Good B: 40% or more and less than 60%

Defective C: less than 40%.

Example 1

Polybutylene terephthalate (PBT) having a melt viscosity of 160 Pa·s was used as core components and polyethylene terephthalate (PET1) having a melt viscosity of 30 Pa·s as a sheath component of the fibers constituting the stretch yarn. After these polymers were individually melted, measurement was performed by a pump such that the discharge amount ratio of the core/sheath was 50/50, and the polymers were separately flowed into the same spinning pack in which the distribution plate having the distribution holes illustrated in FIG. 11A was incorporated, and discharged from the spinneret in which 72 discharge holes were bored with the spinning temperature of 280° C.

The distribution plate used in Example 1 is a distribution plate in which a part of the polymer of the sheath component B covering the core component A becomes a uniform thin skin, and a composite cross section (FIG. 6B) satisfying the requirements of the thin skin eccentric core-sheath cross section is formed when used as a fiber.

The discharged composite polymer flow was cooled and applied with an oil agent, then wound to a roller heated to 65° C. at a rate of 1000 m/min, and then drawn by 3.2 times with a roller heated to 150° C. at a rate of 3200 m/min to obtain a drawn yarn of 56 dtex-72 filaments.

The wound drawn yarn was subjected to a false twisting process at a rotational velocity such that the false twisting number was 3000 T/m using a friction disc while heating with a heater set to 170° C. between rollers having a processing velocity of 250 m/min and a draw ratio of 1.0, thereby obtaining a stretch yarn of 56 dtex-72 filaments.

In addition, since the fiber cross section of the drawn yarn was precisely controlled in the obtained stretch yarn, there was no defect such as fluffing and whitening due to peeling between the core/sheath components in the false twisting process, and the yarn quality and the process passability were excellent.

The obtained stretch yarn had a strength of 3.5 cN/dtex, an elongation of 28% which were sufficient mechanical properties to withstand practical use, and the average diameter of the fibers was 7.5 μm. When the crimping form of the fiber was observed, two groups were observed in the coil diameter distribution, the average value of each group was 85.3 μm and 159.7 μm, and the ratio of the maximum group average value to the minimum group average value was 1.87. The proportion of the fibers included in the group having the minimum group average value of the coil diameters was 51%.

Figure 3:
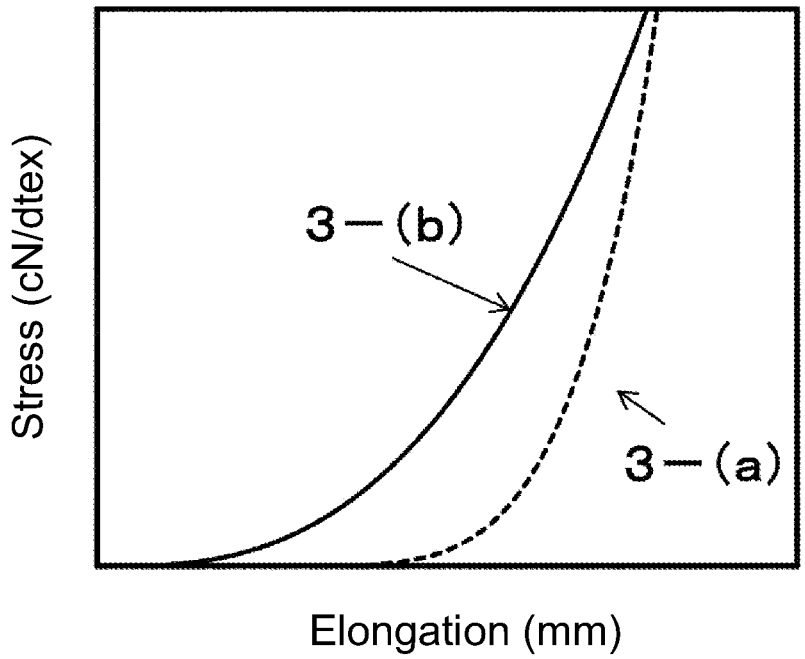
FIG. 3 illustrates a relationship between an elongation and deformation profile of an example of our stretch yarn and a conventional stretch yarn.

As described above, the stretch yarn in Example 1 had a mixture of crimps having a suitable size divergence, and the elongation-stress curve of the stretch yarn in Example 1 showed a high elongation energy of 3.9 μJ/dtex by suitably expressing the stress from the low elongation region and had a suitable elongation resistance force as illustrated by the solid line 3-(*b*) of FIG. 3.

When the stretch yarn in Example 1 was used as a fabric and relaxation treatment was performed, the yarn was excellent in the hold property and was excellent in the motion followability (motion followability: A) by having an appropriate elongation resistance from the low elongation region while exhibiting good stretchability. Furthermore, since the fiber average diameter of the stretch yarn was small, the rubbing between the skin and the fabric was small during elongation, and the adhesiveness to the skin was excellent (adhesiveness: A).

In addition, the fabric made of the stretch yarn of Example 1 had a soft texture, and also had good motion followability. Moreover, the wear resistance according to the Martindale method was 3000 times, which was a good wear resistance that could withstand use in a harsh environment. The results are shown in Table 1.

Example 2 and 3

In each of Examples 2 and 3, a drawn yarn was prepared in the same manner as in Example 1, the stretch yarn was obtained by changing the number of rotation velocity of the friction disc in the false twisting process and performing the false twisting process under the same conditions as in Example 1 except that the false twist number was 3500 T/m and 2500 T/m, respectively.

In Examples 2 and 3, although the frictional force received from the friction disc was changed, the fiber cross section of the drawn yarn was controlled to be the thin skin eccentric core-sheath cross section satisfying our requirements, there was no defect such as fluffing and whitening due to peeling between the core and sheath, and the yarn quality and process passability were excellent.

In each of the stretch yarns of Examples 2 and 3, two groups were seen in the coil diameter distribution, and since the actualized crimp size was changed according to the false twist number, the ratio of the maximum-minimum group mean was changed. In each example, the control was performed within a range in which the desired effects could be exhibited.

In the stretch yarn of Example 2, extremely fine actualized crimping was obtained by increasing the false twist number in the false twisting process, and the ratio of the maximum group average value to the minimum in the coil diameter distribution was increased. For this reason, in the elongation-stress curve of the stretch yarn of Example 2, although the stress expression in the low elongation region was slightly reduced, but the stretch yarn was elongated at a low stress, and the elongation energy was as high as 4.3 μJ/dtex.

Therefore, when the fabric was elongated as a fabric, the fabric was soft and elongated from the low elongation region to the high elongation region, and was excellent in the motion followability.

In the stretch yarn of Example 3, since the false twist number in the false twisting process was low, the ratio of the maximum group average value to the minimum was close in the coil diameter distribution. For this reason, in the elongation-stress curve of the stretch yarn of Example 3, the stress expressed in the low elongation region increased, while the stress increased at a lower elongation, and the elongation energy was 2.6 μJ/dtex, and when elongated as a fabric, the resistance in the low elongation region was softened, and the yarn had a soft motion followability suitable for casual clothing. The results are shown in Table 1.

Examples 4 and 5

In Examples 4 and 5, the stretch yarn was obtained in the same manner as in Example 1 except that the draw ratio in the false twisting process was 1.1 and 0.9, respectively.

In Examples 4 and 5, although the tension in the twisted region was changed and the frictional force received from the friction disc was changed, the fiber cross section of the drawn yarn was precisely controlled, there was no defect such as fluffing and whitening due to peeling between the core and sheath, and the yarn quality and process passability were excellent.

In the stretch yarns of Examples 4 and 5, since the false twist number was the same degree as in Example 1, the coil diameter distribution having the ratio of the maximum group average values to the minimum to the same degree as in Example 1 was obtained, but the proportion of crimping included in the group having the minimum group average value as the center was changed depending on the tension in the twisted region.

In the stretch yarn of Example 4, since the draw ratio was high and the tension in the twisted region was high, the actualized crimping was less likely to be applied, and the proportion of crimping contained in the group having the minimum group average value as the center was reduced. For this reason, in the elongation-stress curve of the stretch yarn of Example 4, since the low stress region corresponding to the elongation of the small coil diameter was reduced, the elongation energy was 1.8 μJ/dtex. When the yarn was elongated as a fabric, the yarn felt a little taut, but it was excellent in the motion followability compared to the related art, and there was no problem.

In the stretch yarn of Example 5, since the tension in the twisted region was low due to the low draw ratio, and the actualized crimping was easily applied, the crimp existed uniformly in the entire multifilament, and the proportion of crimping included in the group having the minimum group average value as the center was increased. For this reason, in the elongation-stress curve of the stretch yarn of Example 5, the low stress region corresponding to the elongation of the small coil diameter was enlarged, and thus the elongation energy was as good as 3.8 μJ/dtex. The results are shown in Table 1.

Example 6

In Example 6, a distribution plate having the same distribution hole as in Example 1 was used, and a spinneret having a discharge hole number of 24 was used.

The polymer constituting the stretch yarn, the discharge ratio of the core/sheath, and the spinning temperature were discharged in the same manner as in Example 1, and by drawing under the same drawing and winding conditions as in Example 1, a drawn yarn of 56 dtex-24 filaments was obtained.

The obtained drawn yarn was subjected to the false twisting process under the conditions in which the rotational velocity of the friction disc was adjusted such that the processing velocity, the draw ratio, and the heater temperature condition were the same as those in Example 1, and the false twisting number of the friction disc was 3000 T/m, thereby obtaining our stretch yarn.

In the stretch yarn obtained in Example 6, as the fiber diameter was increased, the absolute value of the thin skin thickness was increased in the fiber cross section, and the wear resistance was improved, there was no defect such as fluffing and whitening due to peeling between the core/sheath components in the false twisting process, and the yarn quality and the process passability were excellent.

In the stretch yarn of Example 6, the average diameter of the fibers was 15.0 μm, and when the crimping form of the fibers was observed, two groups having a group average value of 137.0 μm and a group average value of 344.0 μm respectively were observed in the coil diameter distribution. In addition to the increase in the coil diameter of the latent/actualized crimping as the average diameter of the fibers was increased, the moment of the fiber expressing the crimped structure was increased. The elongation-stress curve of the stretch yarn of Example 6 exhibited high stress especially at low elongation (elongation energy: 2.5 μJ/dtex). The results are shown in Table 1.

Example 7

In Example 7, a distribution plate having the same distribution holes as in Example 1 was used, and a spinneret having a discharge hole number of 18 was used.

The polymer constituting the stretch yarn, the discharge ratio of the core/sheath, and the spinning temperature were discharged in the same manner as in Example 1, and by drawing under the same drawing and winding conditions as in Example 1, a drawn yarn of 56 dtex-18 filaments was obtained.

The obtained drawn yarn was subjected to the false twisting process under the conditions in which the processing velocity, the draw ratio, and the heater temperature condition were the same as those in Example 1 and the rotational velocity of the friction disc was adjusted such that the false twisting number of the friction disc was 3000 T/m, thereby obtaining the stretch yarn (56 dex-18 filaments, maximum-minimum group average value ratio: 2.62).

In the stretch yarn of Example 7, the average diameter of the fibers was 18.5 and when the crimping form of the fibers was observed, two groups having a group average value of 163.7 μm and a group average value of 429.4 μm respectively were observed in the coil diameter distribution. Due to the increase in the coil diameter of the latent/actualized crimp and the increase in the moment at which the fiber expresses the crimped structure as the average diameter of the fibers was increase, the elongation-stress curve of the stretch yarn of Example 7 exhibited a very high stress (elongation energy: 1.9 μJ/dtex) although the desired effect was not impaired during low elongation.

When the stretch yarn of Example 7 was made into a fabric, the adhesiveness was poor compared to Example 1, but when the yarn was elongated, the holding feeling was high due to a high elongation resistance, and the fabric had a suitable bonding pressure to the extent that the desired effect was not impaired. The results are shown in Table 1.

Examples 8 and 9

In Examples 8 and 9, the polymer was changed as shown in Table 1, and discharge was performed using the same spinneret as in Example 1.

In Example 8, a multifilament was wound around a roller heated to 60° C. at a velocity of 1000 m/min, and then drawn between a roller heated to 150° C. at a velocity of 3400 m/min to obtain a drawn yarn of 56 dtex-72 filaments.

The obtained drawn yarn was subjected to the false twisting process under the conditions in which the processing velocity, the draw ratio, and the heater temperature condition were the same as those in Example 1 and the rotational velocity of the friction disc was adjusted such that the false twisting number of the friction disc was 3000 T/m, thereby obtaining our stretch yarn.

In Example 9, the discharged composite polymer flow was wound around a roller heated to 80° C. at a velocity of 1000 m/min, and then drawn between a roller heated to 150° C. at a velocity of 3000 m/min to obtain a drawn yarn of 56 dtex-72 filaments.

The obtained drawn yarn was subjected to the false twisting process under the conditions in which the processing velocity, and the draw ratio were the same as those in Example 1, the heater temperature was set to 200° C., and the rotational velocity of the friction disc was adjusted such that the false twisting number of the friction disc was 3000 T/m, thereby obtaining the stretch yarn.

In Examples 8 and 9, although the shape of the fiber cross section was slightly changed as the polymer was changed, in both instances, the fiber cross section was controlled to be the thin skin eccentric core-sheath cross section and, therefore, in the false twisting process, there was no defect such as fluffing and whitening due to peeling between the core/sheath component, and the yarn quality and the process passability were excellent.

In Example 8, since PPT, which highly shrinks when subjected to a heat treatment, was used as the core component, fine latent crimping was obtained, and the ratio of the maximum group average value to the minimum in the coil diameter distribution was reduced, but fine crimping was obtained as a whole. In addition, since the Young's modulus of PPT was low, the elongation-stress curve of the stretch yarn of Example 8 was characterized by being drawn very well at low stress, and the elongation energy was excellent at 4.0 μm/dtex. When the yarn was made into a fabric and then elongated, the fabric had a soft elongation resistance to the extent that the desired effect was not impaired, and the stretchability was particularly excellent.

In Example 9, PET2 (melt viscosity: 290 Pa·s) was used as the core component, the Young's modulus of the yarn increased, and the elongation resistance of crimping increased. Therefore, in the elongation-stress curve of the stretch yarn of Example 9, the expressed stress was high as a whole, and the elongation energy was as low as 1.8 μJ/dtex. When the yarn was made into a fabric and then elongated, the hold feeling was high due to the high elongation resistance, and the fabric has a suitable wearing pressure to the extent that the desired effect is not impaired. The results are shown in Table 2.

Example 10

Figure 7:
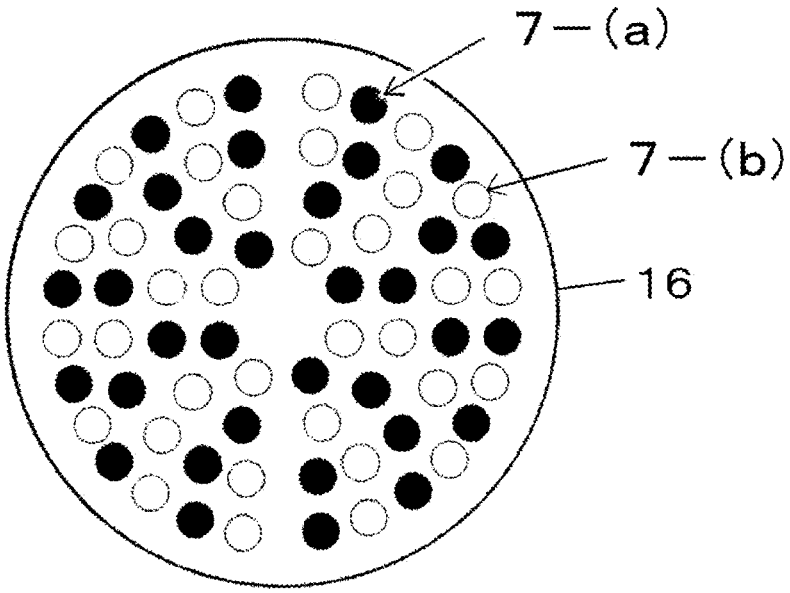
FIG. 7 is a schematic view of an arrangement of discharge holes in a discharge plate of a spinneret used in Example 10.

In Example 10, a distribution plate in which two kinds of distribution hole groups had been bored were used: the number of distribution holes (distribution holes exist on the curve 13 in FIG. 11A) to form the thin skin in the distribution hole groups were different such that, in a fiber to be formed by use of the distribution plate, the fiber cross section was a thin skin eccentric core-sheath cross section and the thin skin thickness was 0.04 and 0.09. The number of discharge holes formed of each of the distribution hole groups is 36 holes. In FIG. 7, the discharge hole arrangement in the discharge plate 16 of the spinneret used in Example 10 was illustrated, and a spinneret having a houndstooth hole arrangement in which the discharge hole group (7-(*a*)) corresponding to the distribution hole group having a thin skin thickness of 0.04 and the discharge hole group (7-(*b*)) corresponding to the distribution hole group having a thin skin thickness of 0.09 were alternately arranged was used.

In Example 10, spinning, drawing, and false twisting were performed in the same manner as in Example 1 except that the above-described distribution plate was used, and a stretch yarn was obtained.

In Example 10, although the thin skin thickness of the constituent fibers was changed, since each of the fibers was controlled to have the thin skin eccentric core-sheath cross section, there was no defect such as fluffing and whitening due to peeling between the core/sheath component in the false twisting process, and the yarn quality and the process passability were excellent.

When the crimping form of the stretch yarn of Example 10 was observed, two kinds of latent crimping and actualized crimping according to the cross-sectional form of the fibers coexisted, and the coil diameter distribution had three groups. Therefore, in the elongation-stress curve, the three kinds of crimping were sequentially deformed according to the elongation of the multifilament so that the rise of the stress was gentle over the low elongation region to the high elongation region, and the elongation energy was as very high as 5.0 μJ/dtex.

Therefore, when the yarn was made into a fabric and then elongated, since the stress is gently expressed according to the elongation, the holdability is very excellent, and the motion followability is extremely good. The results are shown in Table 2.

Example 11

In Example 11, use was made of a spinneret in which 36 holes having a hole diameter of 0.18 mm and 36 holes having a hole diameter of 0.23 mm were formed such that fibers to be formed had fiber diameters of 7.0 μm and 11.0 μm respectively, and a discharge hole having a small hole diameter corresponding to the fine fiber diameter and a discharge hole having a large hole diameter corresponding to the large fiber diameter were disposed in the spinneret surface. FIG. 7 shows the arrangement of the discharge holes in the discharge plate 16 of the spinneret used in Example 11, and the spinneret having a houndstooth hole arrangement in which a discharge hole group (7-(*a*)) having a hole diameter of 0.18 mm and a discharge hole group (7-(*b*)) having a hole diameter of 0.23 mm are alternately arranged was used.

In Example 11, spinning and drawing were performed in the same manner as in Example 1 except that the above-described composite spinneret was used, and our stretch yarn was obtained without performing the false twisting process.

When the crimping form of the stretch yarn of Example 11 was observed, two kinds of latent crimping depending on the fiber diameter of the fiber coexisted, and the coil diameter distribution had two groups. For this reason, in the elongation-stress curve, the two kinds of crimping were sequentially deformed according to the elongation of the multifilament so that the rise of the stress was gentle over the low elongation region to the high elongation region, the elongation energy exhibited a high value of 3.2 μJ/dtex, and had a suitable elongation resistance force.

When the stretch yarn of Example 11 was made into a fabric and relaxation treatment was performed, good stretchability was exhibited, and the hold property was excellent by having appropriate elongation resistance from the low elongation region, and the motion followability was excellent. The results are shown in Table 2.

Comparative Example 1

In Comparative Example 1, a drawn yarn (56 dtex-72 filaments) was prepared in the same manner as in Example 1, and then subjected to a false twisting process under such conditions that the actual twist number in the twisted region became 5500 T/m (the false twist number was $40000/Df^{0.5}$ or more) to obtain a stretch yarn (56 dex-72 filaments, maximum-minimum group average value ratio: 3.00).

In the stretch yarn of Comparative Example 1, since the maximum-minimum coil diameter ratio was larger than that of our stretch yarn, the elongation-stress curve of the stretch yarn of Comparative Example 1 showed a gradual deformation, and a sudden rise in stress was observed. For this reason, in the fabric made of the textured yarn of Comparative Example 1, the resistance rapidly increased according to the elongation, when a large motion was made suddenly, there were some parts that could not follow the motion, and there was partially taut feeling. The results are shown in Table 2.

Comparative Example 2

In Comparative Example 2, spinning and drawing were performed under the same conditions as in Example 1, and the stretch yarn of 56 dtex-72 filaments was obtained without performing the false twisting process.

In the stretch yarn of Comparative Example 2, only one group due to latent crimping was seen in the coil diameter distribution, and the elongation-stress curve was a monotonous profile as shown by a dotted line 3-(*a*) in FIG. 3.

For this reason, when the yarn was made into a fabric, although the fabric had good stretchability, the resistance feeling during low elongation was lacking, and when the fabric was elongated, the fabric was inferior to Example 1 from the viewpoint of good holding feeling and motion followability in a wide range from the low elongation region to the high elongation region. The results are shown in Table 2.

Comparative Example 3

In Comparative Example 3, polyethylene terephthalate (PET3) having a melt viscosity of 120 Pa·s was melted and discharged from a spinneret in which 72 discharge holes was bored, and spun and drawn to obtain a PET sole yarn of 56 dtex-72 filaments. This was subjected to a false twisting process under the same conditions as in Example 1 except that the heater temperature was set to 200° C., thereby obtaining a stretch yarn (56 dtex-72 filaments).

When the crimping form of the stretch yarn of Comparative Example 3 was observed, the coil diameter distribution was broad and did not have the group of our device, and the fibers with a coarse coil diameter were slackened and fixed to the surface of the stretch yarn. Therefore, since slack fibers do not contribute to the stress during elongation, the elongation-stress curve of the stretch yarn of Comparative Example 3 showed that the stress during low elongation is extremely low, and the stress rises sharply after the crimping is fully elongated. The results are shown in Table 2.

Example 12

Polybutylene terephthalate (PBT, melt viscosity: 112 Pa·s) was prepared as the first component polymer, and polyethylene terephthalate (PET, melt viscosity: 39 Pa·s) was prepared as the second component polymer. After the first component polymer and the second component polymer were melted at 260° C. and 280° C. respectively using an extruder, the spinning temperature was set to 280° C. and the measurement was performed by a pump such that the area ratio of the first component polymer and the second component polymer in the fiber cross section was 50/50, the polymers flow into the composite spinneret shown in FIGS. 12A to 12C, and an inflow polymer was discharged at 0.35 g/min/hole from the discharge holes disposed at a hole filling density of $1.2\times10^{-2}$ holes/mm$^2$. At this time, for the distribution plate of the spinneret for composite spinning, use was made of a distribution plate in which a polymer distribution hole group in which a plurality of first component polymer distribution holes of semicircular arrangement are surrounded by a plurality of second component polymer distribution holes in the lowermost layer on the downstream side in the polymer spinning path direction as shown in FIG. 11A, and eight holes out of 64 holes of the second component polymer distribution holes in the polymer distribution hole group were arranged in semicircular arc arrangement on the outer side of the circumferential portion of the plurality of first component polymer distribution holes of semicircular arrangement.

The discharge bending angle of the composite polymer flow discharged from the discharge hole was 36°, and thus the composite polymer had an extremely good discharge stability. The composite polymer flow was applied with an oil agent after cooling and solidification, wound at a spinning velocity of 1000 m/min, and drawn at a draw ratio of 3.0 between the rollers heated to 80° C. and 130° C., thereby obtaining a composite fiber having 56 dtex-48 filaments (single fiber fineness: 1.2 dtex) through a spinning/drawing process. The number of yarn breakage in this spinning/drawing process was 0.3 times/10 million m, which was extremely good yarn manufacturing stability.

The composite cross section of the obtained composite fiber was an eccentric core-sheath cross section as shown in FIG. 11B in which the first component polymer was the core and the second component polymer was the sheath, and the thickness proportion of the thin skin portion was as thin as 4%, and the thickness variation of the thin skin portion was 10%, which provided a high dimensional stability of the composite cross section. In addition, the stretch-elongation ratio of the composite fiber was 65%, and the composite fiber had an extremely good crimp-expressing property. The results are shown in Table 3.

Comparative Example 4

Figure 8B:
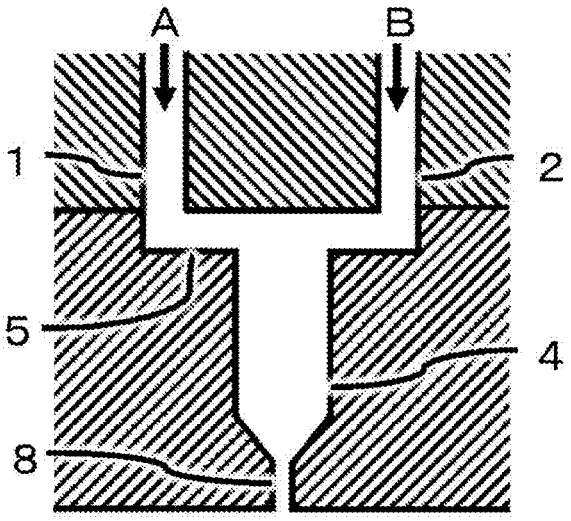
FIG. 8B PRIOR ART
Figure 8C:
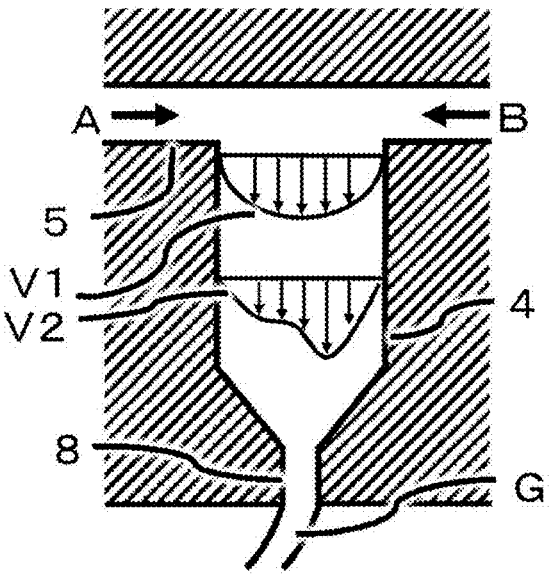
FIG. 8C PRIOR ART

A composite fiber of 56 dtex-48 filaments was obtained all according to Example 12, except that the polymer flow was caused to flow into the conventional composite spinneret used for spinning a composite fiber having a side-by-side cross section as shown in FIG. 8B, and the inflow polymer was discharged at 0.35 g/min/hole from the discharge hole disposed at the hole filling density of $1.2\times10^{-2}$ holes/mm$^2$, which is the processing limit.

In the spinning/drawing step of the obtained composite fiber, the discharge bending of the composite polymer flow discharged from the discharge holes was larger than in Example 12. In addition, the yarn jitter of the polymer flow during spinning and the yarn breakage due to the contact with the spinneret surface occurred frequently. The results are shown in Table 3.

Comparative Example 5

A composite fiber of 56 dtex-48 filaments was obtained all according to Example 12, except that the polymer flow was caused to flow into a conventional composite spinneret used for spinning a composite fiber having an eccentric core-sheath cross section as shown in FIG. 10B, and the inflow polymer was discharged at 0.35 g/min/hole from the discharge hole disposed at a hole filling density of $6.1\times10^{-3}$ holes/mm$^2$, which is a processing limit.

In the spinning and drawing process of the obtained composite fiber, since the flow rate of the polymer forming the thin skin portion was very small, abnormal retention of the polymer occurred in the flow path in the composite spinneret and yarn breakage during drawing was frequently occurred due to the incorporation of the deteriorated polymer. In addition, the composite cross section of the obtained composite fiber had a large variation in the thickness of the thin skin portion compared to Example 12, and was inferior in dimensional stability of the composite cross section. The results are shown in Table 3.

Comparative Example 6

A composite fiber of 56 dtex-48 filaments was obtained all according to Example 12, except that a distribution plate in which the arrangement of the first component polymer distribution holes in the polymer distribution hole group bored in the lowermost layer on the downstream side in the polymer spinning path direction was arranged in a circular arrangement as shown in FIG. 14A was used for the distribution plate of the spinneret for composite spinning.

The obtained composite fiber had a large crimping because the position of the center of gravity of the core component was close to the center of the cross section of the composite fiber, and the crimp-expressing property was significantly reduced compared to Example 12. The results are shown in Table 3.

Example 13 and 14

A composite fiber of 56 dtex-48 filaments was obtained all according to Example 12, except that as the distribution plate of the spinneret for the composite spinning, a distribution plate in which 6 holes (Example 13) and 4 holes (Example 14) out of 64 holes of the second component polymer distribution holes in the polymer distribution hole group bored in the lowermost layer on the downstream side in the polymer spinning path direction were arranged in semicircular arc arrangement on the outer side of the circumferential portion of the plurality of first component polymer distribution holes of semicircular arrangement was used.

In the obtained composite fiber, as the number of holes of the second component polymer distribution holes arranged in the semicircular arc arrangement became smaller, the position of the center of gravity of the core component was more distant from the center of the cross section of the composite fiber so that the crimping was finer, and the crimp-expressing property was better than that of Example 12. The results are shown in Table 3.

Examples 15 and 16

A composite fiber of 56 dtex-48 filaments was obtained all according to Example 12, except that as the distribution plate of the spinneret for the composite spinning, a distribution plate in which 12 holes (Example 15) and 16 holes (Example 16) out of 64 holes of the second component polymer distribution holes in the polymer distribution hole group bored in the lowermost layer on the downstream side in the polymer spinning path direction were arranged in semicircular arc arrangement on the outer side of the circumferential portion of the plurality of first component polymer distribution holes of semicircular arrangement was used.

In the obtained composite fiber, as the number of holes of the second component polymer distribution holes arranged in the semicircular arc arrangement increased, the thickness of the thin skin portion was increased compared to Example 12, and thus the discharge bending of the composite polymer flow discharged from the discharge holes was small. In addition, yarn jitter of the polymer flow during spinning and yarn breakage due to contact with the spinneret surface hardly occurred. The results are shown in Table 3.

Example 17

A composite fiber of 56 dtex-72 filaments was obtained all according to Example 12, except that the inflow polymer was discharged at 0.23 g/min/hole from the discharge hole disposed at the hole filling density of $1.8\times10^{-2}$ holes/mm$^2$.

Since the obtained composite fiber has a reduced single fiber fineness, the rigidity of the yarn is reduced, and therefore, the fabric using the composite fiber has good stretchability and excellent texture. The results are shown in Table 4.

Comparative Example 7

The spinning was performed all according to Example 12, except that the polymer flow was flowed into the conventional composite spinneret used for spinning a composite fiber having a side-by-side cross section as shown in FIG. 8B, and the inflow polymer was discharged at 0.23 g/min/hole from the discharge hole disposed at the hole filling density of $1.2\times10^{-2}$ holes/mm$^2$, which is the processing limit. As a result, since the discharge amount was reduced and the gravity was reduced compared to Comparative Example 4, the discharge bending of the composite polymer flow discharged from the discharge hole was further deteriorated, the polymer flow constantly contacted the spinneret surface during spinning, and spinning was impossible. The results are shown in Table 4.

Comparative Example 8

A composite fiber of 56 dtex-72 filaments was obtained all according to Example 12, except that the polymer flow was caused to flow into a conventional composite spinneret used for spinning a composite fiber having an eccentric core-sheath cross section as shown in FIG. 10B, and the inflow polymer was discharged at 0.23 g/min/hole from the discharge hole disposed at a hole filling density of $6.1\times10^{-3}$ holes/mm$^2$, which is a processing limit.

In the spinning and drawing process of the obtained composite fiber, compared to Comparative Example 5, since the flow rate of the polymer forming the thin skin portion was very small, abnormal retention of the polymer occurred in the flow path in the composite spinneret and yarn breakage during drawing frequently occurred due to the incorporation of the deteriorated polymer. In addition, also in the composite cross section of the obtained composite fiber, the thickness variation of the thin skin portion was further increased, and the dimensional stability of the composite cross section was significantly deteriorated. The results are shown in Table 4.

Example 18

A composite fiber of 56 dtex-48 filaments was obtained all according to Example 12 except that the first component polymer was polybutylene terephthalate (PBT, melt viscosity: 218 Pa·s).

In the obtained composite fiber, the viscosity ratio between the first component polymer and the second component polymer was increased so that the first component polymer which is a high shrinkage component was highly oriented and the crimping became finer as the shrinkage difference was increased, and the crimp-expressing property was better than in Example 12. The results are shown in Table 4.

Comparative Example 9

The spinning was performed all according to Example 12 except that the polymer flow was flowed into the conventional composite spinneret used for spinning a composite fiber having a side-by-side cross section as shown in FIG. 8B and the inflow polymer was discharged at 0.35 g/min/hole from the discharge hole disposed at the hole filling density of $1.2\times10^{-2}$ holes/mm$^2$, which is the processing limit. As a result, the viscosity ratio of the first component polymer and the second component polymer was increased compared to Comparative Example 4, the discharge bending of the composite polymer flow discharged from the discharge hole was further deteriorated, the polymer flow constantly contacted the spinneret surface during spinning, and spinning was impossible. The results are shown in Table 4.

Example 19

A composite fiber of 56 dtex-48 filaments was obtained all according to Example 12 except that the first component polymer was polytrimethylene terephthalate (PTT, melt viscosity: 109 Pa·s).

In the obtained composite fiber, since the first component polymer was changed from PBT to PTT, the crimp-expressing property under a load was good, and high stretchability was obtained when the composite fiber was made into a fabric. The results are shown in Table 4.

Example 20

A composite fiber of 56 dtex-48 filaments was obtained all according to Example 12 except that the first component polymer was polyoxytetramethylene glycol 20%-copolymerized polybutylene terephthalate (PTMG 20%-copolymerized PBT, melt viscosity: 410 Pa·s).

The obtained composite fiber had a strong elastic behavior since the first component polymer was changed from PBT to PTMG-copolymerized PBT, and a spandex-like stretchability can be obtained when used as a fabric. The results are shown in Table 4.

TABLE 1

| | | | Example 1 | Example 2 | Example 3 | Example 4 | Example 5 | Example 6 | Example 7 |
|---|---|---|---|---|---|---|---|---|---|
| Yarn | Polymer | Core Component | PBT | PBT | PBT | PBT | PBT | PBT | PBT |
| | | Sheath Component | PET1 | PET1 | PET1 | PET1 | PET1 | PET1 | PET1 |
| | Single yarn cross section | Cross Section Shape | Thin Skin Eccentric Core-sheath | Thin Skin Eccentric Core-sheath | Thin Skin Eccentric Core-sheath | Thin Skin Eccentric Core-sheath | Thin Skin Eccentric Core-sheath | Thin Skin Eccentric Core-sheath | Thin Skin Eccentric Core-sheath |
| | | S/D | 0.04 | 0.04 | 0.04 | 0.04 | 0.04 | 0.05 | 0.04 |
| | | S Ratio (%) | 44 | 44 | 44 | 44 | 44 | 46 | 44 |
| | Average Diameter of Single Fiber (μm) | | 7.5 | 7.5 | 7.5 | 7.5 | 7.5 | 15.0 | 18.5 |
| | Number of Groups | | 2 | 2 | 2 | 2 | 2 | 2 | 2 |
| | Group 1 | Group Average Value (μm) | 85.3 | 60.8 | 131.5 | 90.2 | 79.8 | 137.0 | 163.7 |
| | Group 2 | Group Average Value (μm) | 159.7 | 168.2 | 162.0 | 165.5 | 161.1 | 344.0 | 429.4 |
| | Group 3 | Group Average Value (μm) | — | — | — | — | — | — | — |

TABLE 1-continued

| | | | Example 1 | Example 2 | Example 3 | Example 4 | Example 5 | Example 6 | Example 7 |
|---|---|---|---|---|---|---|---|---|---|
| Yarn | Maximum Group Average Value/Minimum Group Average Value | | 1.87 | 2.77 | 1.23 | 1.83 | 2.02 | 2.51 | 2.62 |
| | Proportion of Minimum Group (%) | | 51 | 52 | 49 | 41 | 65 | 47 | 45 |
| | Strength | cN/dtex | 3.5 | 3.4 | 3.5 | 3.7 | 3.5 | 3.7 | 3.8 |
| | Elongation | % | 28 | 25 | 32 | 24 | 26 | 31 | 32 |
| | Elongation Energy | μJ/dtex | 3.9 | 4.3 | 2.6 | 1.8 | 3.8 | 2.5 | 1.9 |
| Fabric | Motion Followability | | A | A | B | B | A | B | B |
| | Adhesiveness | | A | A | A | A | A | B | B |
| | Wear Resistance | Times | 3000 | 2800 | 3200 | 2600 | 3300 | 3500 | 3600 |

PBT: Polybutylene terephthalate (melt viscosity: 160 Pa · s)
PET1: Polyethylene terephthalate (melt viscosity: 30 Pa · s)
PET2: High-molecular weight polyethylene terephthalate (melt viscosity: 290 Pa · s)
PET3: Medium-molecular weight polyethylene terephthalate (melt viscosity: 120 Pa · s)
PPT: Polytrimethylene terephthalate (melt viscosity: 130 Pa· s)

TABLE 2

| | | | Example 8 | Example 9 | Example 10 | Example 11 | Comparative Example 1 | Comparative Example 2 | Comparative Example 3 |
|---|---|---|---|---|---|---|---|---|---|
| Yarn | Polymer | Core Component | PTT | PET2 | PBT | PBT | PBT | PBT | PET3 |
| | | Sheath Component | PET1 | PET1 | PET1 | PET1 | PET1 | PET1 | — |
| | Single yarn cross section | Cross Section Shape | Thin Skin Eccentric Core-sheath | Thin Skin Eccentric Core-sheath | Thin Skin Eccentric Core-sheath | Thin Skin Eccentric Core-sheath | Thin Skin Eccentric Core-sheath | Thin Skin Eccentric Core-sheath | Single |
| | | S/D | 0.04 | 0.05 | 0.04/0.09 | 0.04 | 0.04 | 0.04 | — |
| | | S Ratio (%) | 42 | 38 | 44/47 | 44 | 44 | 44 | — |
| | Average Diameter of Single Fiber (μm) | | 7.5 | 7.5 | 7.5 | 7/11 | 7.5 | 7.5 | 7.5 |
| | Number of Groups | | 2 | 2 | 3 | 2 | 2 | 1 | 0 |
| | Group 1 | Group Average Value (μm) | 92.0 | 81.2 | 89.3 | 101.1 | 60.2 | 142.2 | — |
| | Group 2 | Group Average Value (μm) | 141.3 | 192.0 | 149.7 | 154.3 | 180.5 | — | — |
| | Group 3 | Group Average Value (μm) | — | — | 184.2 | — | — | — | — |
| Yam | Maximum Group Average Value/Minimum Group Average Value | | 1.54 | 2.36 | 2.06 | 1.53 | 3.00 | — | — |
| | Proportion of Minimum Group (%) | | 48 | 53 | 48 | 50 | 58 | — | — |
| | Strength | cN/dtex | 3.3 | 3.9 | 3.6 | 3.6 | 3.3 | 3.7 | 3.9 |
| | Elongation | % | 28 | 25 | 28 | 28 | 22 | 36 | 29 |
| | Elongation Energy | μJ/dtex | 4.0 | 1.8 | 5.0 | 3.2 | 1.2 | 1.4 | 0.5 |
| Fabric | Motion Followability | | B | B | A | A | C | C | C |
| | Adhesiveness | | A | B | A | A | B | B | C |
| | Wear Resistance | Times | 3000 | 3500 | 3000 | 3000 | 2400 | 3000 | 3400 |

PBT: Polybutylene terephthalate (melt viscosity: 160 Pa · s)
PET1: Polyethylene terephthalate (melt viscosity: 30 Pa · s)
PET2: High-molecular weight polyethylene terephthalate (melt viscosity: 290 Pa · s)
PET3: Medium-molecular weight polyethylene terephthalate (melt viscosity: 120 Pa · s)
PPT: Polytrimethylene terephthalate (melt viscosity: 130 Pa · s)

TABLE 3

Figure 9A:
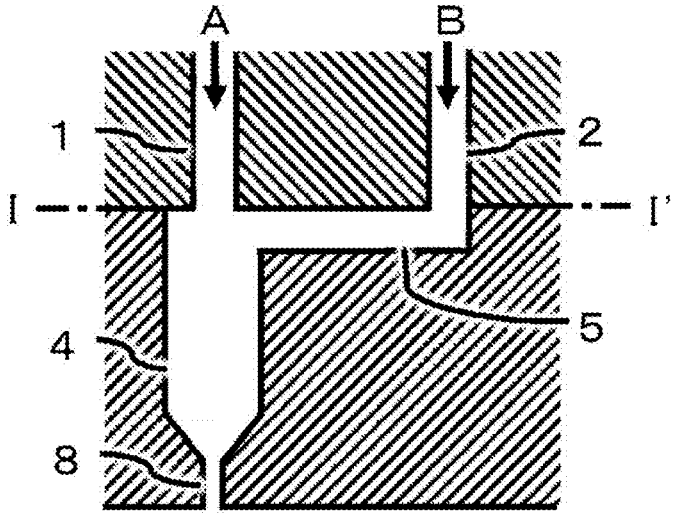
FIG. 9A PRIOR ART
Figure 9B:
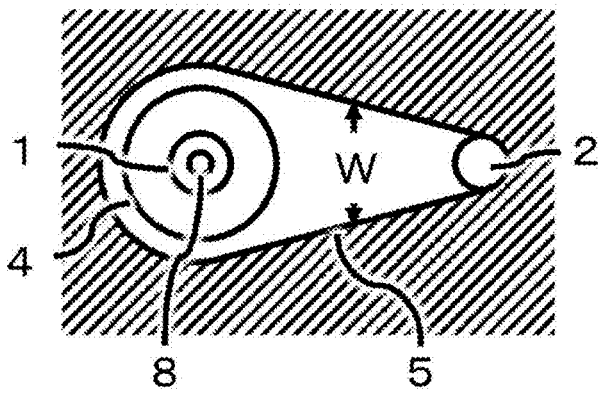
FIG. 9B PRIOR ART
Figure 9C:
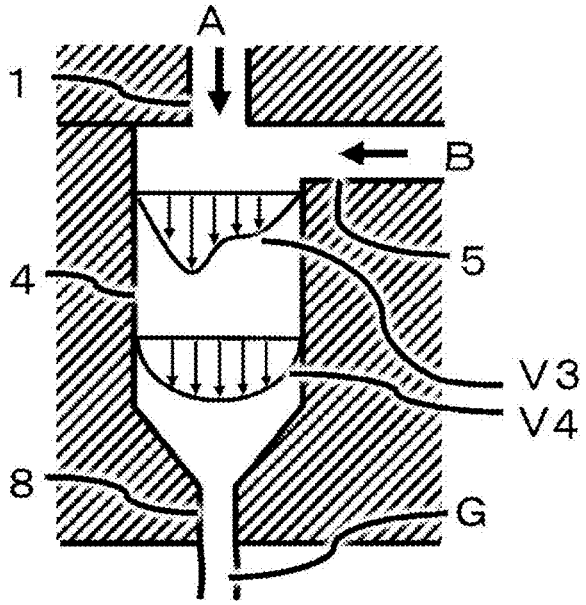
FIG. 9C PRIOR ART

| | | Example 12 | Comparative Example 4 | Comparative Example 5 | Comparative Example 6 |
|---|---|---|---|---|---|
| Composite Spinneret | With or Without Distribution Type Spinneret | With (FIG. 11A) | Without (FIG. 7) | Without (FIG. 9) | With (FIG. 14A) |
| | Arrangement of first polymer component distribution holes | Semicircular Arrangement | — | — | Circular Arrangement |
| | Number of Holes Ho of Second Component Polymer Distribution Holes Arranged in Semicircular Ring Arrangement (holes) | 8 | — | — | 8 |
| | Total Number of Holes Ht of Second Component Polymer Distribution Holes | 64 | — | — | 64 |
| | Ho/Ht | 1/8 | — | — | 1/8 |
| | Hole Filling Density (Holes/mm$^2$) | $1.2 \times 10^{-2}$ | $1.2 \times 10^{-2}$ | $1.2 \times 10^{-2}$ | $1.2 \times 10^{-2}$ |
| Manufacture Conditions | First Polymer Component | PBT | PBT | PBT | PBT |
| | Second Polymer Component | PET | PET | PET | PET |
| | Viscosity Ratio ($V_1/V_2$) | 2.9 | 2.9 | 2.9 | 2.9 |
| | Discharge Amount per Discharge Hole (g/min/hole) | 0.35 | 0.35 | 0.35 | 0.35 |
| | Discharge Stability (Discharge Bending Angle(°)) | A (36) | C (65) | A (35) | A |
| | Yarn Manufacturing Stability (Number of Yarn Breakage per 10 million m) | A (0.3) | C (7.1) | C (2.2) | A |
| Composite Fiber | Single Fiber Fineness (dtex) | 1.2 | 1.2 | 1.2 | 1.2 |
| | Composite Cross Section | Eccentric Core-sheath (FIG. 10) | Side-by-side (FIG. 7) | Eccentric Core-sheath (FIG. 9) | Eccentric Core-sheath (FIG. 13) |
| | Thickness Proportion of Thin Skin Portion (%) | 4.1 | — | 4.1 | 4.3 |
| | Thickness Variation of Thin Skin Portion (%) | 10 | — | 33 | 10 |
| | Crimp-expressing Property (Stretch-elongation Ratio (%)) | A (65) | A (72) | A (64) | C (34) |

| | | Example 13 | Example 14 | Example 15 | Example 16 |
|---|---|---|---|---|---|
| Composite Spinneret | With or Without Distribution Type Spinneret | With (FIG. 11A) | With (FIG. 11A) | With (FIG. 11A) | With (FIG. 11A) |
| | Arrangement of first polymer component distribution holes | Semicircular Arrangement | Semicircular Arrangement | Semicircular Arrangement | Semicircular Arrangement |
| | Number of Holes Ho of Second Component Polymer Distribution Holes Arranged in Semicircular Ring Arrangement (holes) | 6 | 4 | 12 | 16 |
| | Total Number of Holes Ht of Second Component Polymer Distribution Holes | 64 | 64 | 64 | 64 |
| | Ho/Ht | 3/32 | 1/16 | 3/16 | 1/4 |
| | Hole Filling Density (Holes/mm$^2$) | $1.2 \times 10^{-2}$ | $1.2 \times 10^{-2}$ | $1.2 \times 10^{-2}$ | $1.2 \times 10^{-2}$ |
| Manufacture Conditions | First Polymer Component | PBT | PBT | PBT | PBT |
| | Second Polymer Component | PET | PET | PET | PET |
| | Viscosity Ratio ($V_1/V_2$) | 2.9 | 2.9 | 2.9 | 2.9 |
| | Discharge Amount per Discharge Hole (g/min/hole) | 0.35 | 0.35 | 0.35 | 0.35 |
| | Discharge Stability (Discharge Bending Angle(°)) | B (48) | B (57) | A (24) | A (14) |
| | Yarn Manufacturing Stability (Number of Yarn Breakage per 10 million m) | B (0.9) | B (1.8) | A (0.3) | A (0.4) |
| Composite Fiber | Single Fiber Fineness (dtex) | 1.2 | 1.2 | 1.2 | 1.2 |
| | Composite Cross Section | Eccentric Core-sheath (FIG. 10) | Eccentric Core-sheath (FIG. 10) | Eccentric Core-sheath (FIG. 10) | Eccentric Core-sheath (FIG. 10) |
| | Thickness Proportion of Thin Skin Portion (%) | 3.2 | 2.0 | 6.3 | 8.1 |
| | Thickness Variation of Thin Skin Portion (%) | 16 | 25 | 8 | 9 |
| | Crimp-expressing Property (Stretch-elongation Ratio (%)) | A (68) | A (70) | B (52) | B (41) |

PET: Polyethylene terephthalate
PBT: Polybutylene terephthalate

TABLE 4

| | | Example 17 | Comparative Example 7 | Comparative Example 8 | Example 18 |
|---|---|---|---|---|---|
| Composite Spinneret | With or Without Distribution Type Spinneret | With (FIG. 11A) | Without (FIG. 7) | Without (FIG. 9) | With (FIG. 11A) |
| | Arrangement of first polymer component distribution holes | Semicircular Arrangement | — | — | Semicircular Arrangement |
| | Number of Holes Ho of Second Component Polymer Distribution Holes Arranged in Semicircular Ring Arrangement (holes) | 8 | — | — | 8 |
| | Total Number of Holes Ht of Second Component Polymer Distribution Holes | 64 | — | — | 64 |
| | Ho/Ht | 1/8 | — | — | 1/8 |
| | Hole Filling Density (Holes/mm$^2$) | $1.8 \times 10^{-2}$ | $1.2 \times 10^{-2}$ | 6.1 × 10−3 | $1.2 \times 10^{-2}$ |
| Manufacture Conditions | First Polymer Component | PBT | PBT | PBT | PBT |
| | Second Polymer Component | PET | PET | PET | PET |
| | Viscosity Ratio ($V_1/V_2$) | 2.9 | 2.9 | 2.9 | 5.6 |
| | Discharge Amount per Discharge Hole (g/min/hole) | 0.23 | 0.23 | 0.23 | 0.35 |
| | Discharge Stability (Discharge Bending Angle(°)) | A (42) | C (78) | A | B (50) |
| | Yarn Manufacturing Stability (Number of Yarn Breakage per 10 million m) | A (0.6) | C (spinning was impossible) | C (5.3) | B (50) |
| Composite Fiber | Single Fiber Fineness (dtex) | 0.8 | — | 0.8 | 1.2 |
| | Composite Cross Section | Eccentric Core-sheath (FIG. 10) | — | Eccentric Core-sheath (FIG. 9) | Eccentric Core-sheath (FIG. 10) |
| | Thickness Proportion of Thin Skin Portion (%) | 4.1 | — | 4.1 | 4.2 |
| | Thickness Variation of Thin Skin Portion (%) | 12 | — | 36 | 15 |
| | Crimp-expressing Property (Stretch-elongation Ratio (%)) | A (61) | — | A (62) | A (82) |

| | | Comparative Example 9 | Example 19 | Example 20 |
|---|---|---|---|---|
| Composite Spinneret | With or Without Distribution Type Spinneret | Without (FIG. 7) | With (FIG. 11A) | With (FIG. 11A) |
| | Arrangement of first polymer component distribution holes | — | Semicircular Arrangement | Semicircular Arrangement |
| | Number of Holes Ho of Second Component Polymer Distribution Holes Arranged in Semicircular Ring Arrangement (holes) | — | 8 | 8 |
| | Total Number of Holes Ht of Second Component Polymer Distribution Holes | — | 64 | 64 |
| | Ho/Ht | — | 1/8 | 1/8 |
| | Hole Filling Density (Holes/mm$^2$) | $1.2 \times 10^{-2}$ | $1.2 \times 10^{-2}$ | $1.2 \times 10^{-2}$ |
| Manufacture Conditions | First Polymer Component | PBT | PTT | PTMG 20%-copolymerized PBT |
| | Second Polymer Component | PET | PET | PET |
| | Viscosity Ratio ($V_1/V_2$) | 5.6 | 2.8 | 10.6 |
| | Discharge Amount per Discharge Hole (g/min/hole) | 0.35 | 0.35 | 0.35 |
| | Discharge Stability (Discharge Bending Angle(°)) | C (84) | A (38) | B (57) |
| | Yarn Manufacturing Stability (Number of Yarn Breakage per 10 million m) | C (spinning was impossible) | A (0.7) | B (1.3) |
| Composite Fiber | Single Fiber Fineness (dtex) | — | 1.2 | 1.2 |
| | Composite Cross Section | — | Eccentric Core-sheath (FIG. 10) | Eccentric Core-sheath (FIG. 10) |
| | Thickness Proportion of Thin Skin Portion (%) | — | 4.1 | 4.3 |
| | Thickness Variation of Thin Skin Portion (%) | — | 8 | 18 |
| | Crimp-expressing Property (Stretch-elongation Ratio (%)) | — | A (73) | A (104) |

PET: Polyethylene terephthalate
PPT: Polytrimethylene terephthalate
PBT: Polybutylene terephthalate
PTMG: Polyoxytetramethylene glycol Although our stretch yarns, fiber products, composite spinnerets and methods have been described in detail using specific examples, it will be apparent to those skilled in the art that various modifications and variations are possible without departing from the spirit and scope of the appended claims. This application is based on Japanese patent application No. 2018-209024 filed on Nov. 6, 2018 and Japanese patent application No. 2018-209025 filed on Nov. 6, 2018, the entire subject matters of which are incorporated by reference.

The invention claimed is:

1. A stretch yarn comprising a multifilament including fibers having a coiled crimping form in a fiber axial direction, wherein a coil diameter distribution of crimping in the yarn has two or more groups, a ratio of large coil diameter fibers having a maximum group average value to small coil diameter fibers having a minimum group average value of the coil diameter (a maximum group average value/a minimum group average value) is 1.50 or more and less than 3.00, wherein large coil diameter fibers and small coil diameter fibers are at least partially entangled with each other; an Uster unevenness U %, which is an index of unevenness in the fiber longitudinal direction, is 1.5% or less, and a cross section of the fibers constituting the multifilament is an eccentric core-sheath cross section;

Wherein the fibers having a large coil diameter are partially deformed to follow the elongation deformation of the fibers having a small coil diameter, wherein the extension energy is 1.5 μJ/dtex or more.

2. The stretch yarn according to claim 1, wherein the number of fibers included in the group having the minimum group average value of the coil diameter is 20% or more of the total number of fibers constituting the multifilament.

3. The stretch yarn according to claim 1, wherein an average diameter of the fibers constituting the multifilament is 15 μm or less.

4. A fiber product comprising the stretch yarn according to claim 1 in at least a part of the fiber product.

5. A stretch yarn comprising:

a multifilament including two or more groups of fibers, each having a coiled crimping form in an axial direction, wherein a first group of the two or more groups of fibers comprises large coil diameter fibers having a coil diameter having a maximum group average value a second group of two or more groups of fibers comprises small coil diameter fiber having a coil diameter having a minimum group average value and wherein a coil diameter distribution of crimping in the fiber has a ratio of a maximum group average value to a minimum group average value of the coil diameter (a maximum group average value/a minimum group average value) is 1.50 or more and less than 3.00 wherein the large coil diameter fibers and the small coil diameter fibers are at least partially entangled with each other;

wherein the stretch yarn has an Uster unevenness U % is 1.5% or less, and a cross section of the fiber constituting the multifilament is an eccentric core-sheath cross section;

wherein the fibers having a large coil diameter are partially deformed to follow the elongation deformation of the fibers having a small coil diameter wherein the extension energy is 1.5 μJ/dtex or more.

6. The stretch yarn according to claim 5, wherein fibers having different diameters are deformed in an inclined manner according to the elongation of the textured yarn.

7. The stretch yarn according to claim 5, wherein the stretch yarn is substantially free from convergence and non-convergence portions.

* * * * *